US012455138B1

(12) United States Patent
Hunger

(10) Patent No.: US 12,455,138 B1
(45) Date of Patent: Oct. 28, 2025

(54) SLIDING GUN REST SYSTEM AND METHOD OF USE

(71) Applicant: Drew Hunger, Katy, TX (US)

(72) Inventor: Drew Hunger, Katy, TX (US)

( * ) Notice: Subject to any disclaimer, the term of this patent is extended or adjusted under 35 U.S.C. 154(b) by 0 days.

(21) Appl. No.: 18/888,360

(22) Filed: Sep. 18, 2024

Related U.S. Application Data

(63) Continuation-in-part of application No. 16/997,352, filed on Aug. 19, 2020, now Pat. No. 12,135,181.

(51) Int. Cl.
*F41A 27/22* (2006.01)

(52) U.S. Cl.
CPC ..... *F41A 27/22* (2013.01)

(58) Field of Classification Search
CPC ..... F41A 23/16; F41A 23/24; F41A 23/02; F41A 23/04; F41A 27/22; F41A 27/24; A01M 31/025
USPC ..... 42/94; 211/64
See application file for complete search history.

(56) References Cited

U.S. PATENT DOCUMENTS

| | | | | |
|---|---|---|---|---|
| 2,291,747 | A | | 8/1942 | Herman |
| 2,329,932 | A | | 9/1943 | Nelson |
| 2,658,777 | A | | 11/1953 | Rauglas |
| 3,126,187 | A | | 3/1964 | Mooney |
| 3,228,647 | A | | 1/1966 | Musianowycz |
| 3,666,311 | A | | 5/1972 | McMullin |
| 3,807,574 | A | | 4/1974 | Lanza |
| 3,835,486 | A | | 9/1974 | Benoit et al. |
| 4,007,554 | A | | 2/1977 | Helmstadter |
| 4,188,007 | A | | 2/1980 | Ubezio |
| 4,345,398 | A | | 8/1982 | Pickett |
| 4,374,581 | A | | 2/1983 | Karapita |
| 4,393,614 | A | | 7/1983 | Pickett |
| 4,501,082 | A | | 2/1985 | Phillips et al. |
| 4,506,466 | A | | 3/1985 | Hall |
| 4,535,559 | A | | 8/1985 | Hall |
| 4,563,829 | A | | 1/1986 | Bozick |
| 4,575,964 | A | | 3/1986 | Griffin |
| 4,580,483 | A | | 4/1986 | Garbini |
| 4,702,029 | A | | 10/1987 | DeVaul et al. |
| 4,719,716 | A | | 1/1988 | Chrisley, Jr. |
| 4,854,066 | A | | 8/1989 | Canterbury, Sr. |
| 4,876,814 | A | | 10/1989 | Lombardo |
| 4,913,391 | A | | 4/1990 | Klipp |
| 4,924,616 | A | | 5/1990 | Bell |
| 4,937,965 | A | | 7/1990 | Narvaez |
| 4,987,694 | A | | 1/1991 | Lombardo |
| 4,998,944 | A | | 3/1991 | Lund |
| 5,011,104 | A | | 4/1991 | Fang |
| 5,039,052 | A | | 8/1991 | Carafice |
| 5,044,590 | A | | 9/1991 | Carafice |
| 5,050,330 | A | | 9/1991 | Pilgrim et al. |
| 5,070,636 | A | * | 12/1991 | Mueller ..... F41A 23/16 73/167 |
| 5,173,563 | A | | 12/1992 | Gray |
| 5,241,772 | A | | 9/1993 | Hall |

(Continued)

*Primary Examiner* — Jonathan C Weber
(74) *Attorney, Agent, or Firm* — Hitchcock Evert LLP

(57) ABSTRACT

A sliding gun rest system includes a rail secured to a structure; a rest body secured to the rail; a support cradle secured to the rest body, the support cradle is configured to hold a firearm and is configured to move relative the rail; and a restraint device secured to the rest body, the restraint device is configured to stop movement of support cradle relative to the rail.

22 Claims, 15 Drawing Sheets

(56) References Cited

U.S. PATENT DOCUMENTS 5,272,955 A 12/1993 Bond et al.
5,311,693 A 5/1994 Underwood
5,317,826 A 6/1994 Underwood
5,332,185 A 7/1994 Walker, III
5,351,867 A 10/1994 Vest
5,377,437 A 1/1995 Underwood
5,419,233 A 5/1995 Mulvaney
5,421,115 A 6/1995 McKay
5,481,817 A * 1/1996 Parker ..... F41A 23/02 248/286.1
5,589,903 A 12/1996 Speggiorin
5,600,913 A 2/1997 Minneman
D381,388 S 7/1997 Raia
D382,035 S 8/1997 Swicegood
5,666,757 A 9/1997 Helmstadter
5,685,104 A 11/1997 Breazeale, Jr.
5,697,537 A 12/1997 Bowlsby
5,697,757 A 12/1997 Lindsay
5,715,624 A 2/1998 Hilbelink et al.
5,715,625 A 2/1998 West, III
5,716,062 A 2/1998 Lindsay
5,738,256 A 4/1998 Goff et al.
5,778,589 A 7/1998 Teague
5,845,427 A 12/1998 Taylor
5,903,995 A 5/1999 Brubach
5,913,667 A 6/1999 Smilee
5,913,668 A 6/1999 Messer
5,930,931 A 8/1999 Watson
5,933,999 A 8/1999 McClure et al.
5,953,846 A 9/1999 Shelton
5,964,435 A 10/1999 Peltier
5,971,334 A 10/1999 Crawshaw et al.
5,974,719 A 11/1999 Simonek
6,019,556 A 2/2000 Hess
6,035,572 A 3/2000 Goode, Jr.
6,044,747 A 4/2000 Felts
6,086,031 A 7/2000 Renfro
6,158,159 A 12/2000 Zekas
6,176,169 B1 1/2001 Rostocil
6,192,613 B1 2/2001 Lantz
6,243,979 B1 6/2001 Seats et al.
6,263,776 B1 7/2001 Rostocil
6,276,087 B1 8/2001 Singletary
6,283,428 B1 9/2001 Maples et al.
6,305,116 B1 10/2001 Parker
6,315,256 B1 11/2001 Tolar
D461,519 S 8/2002 Monteer
D471,248 S 3/2003 Jacobs
6,526,687 B1 3/2003 Looney
6,539,660 B1 4/2003 Yeargin
6,564,790 B2 5/2003 Graham
6,574,899 B1 6/2003 Mostello
6,578,309 B1 6/2003 Frisce
6,629,380 B2 10/2003 Yeargin
6,634,530 B1 10/2003 Black
6,694,661 B1 2/2004 Langford
6,726,163 B2 4/2004 Eppard et al.
6,749,099 B2 6/2004 Danielson
6,802,483 B1 10/2004 Leasure
6,871,440 B2 3/2005 Highfill et al.
6,883,263 B1 4/2005 Carrow
D506,521 S 6/2005 Strahan
6,920,713 B1 7/2005 Love
6,931,777 B1 8/2005 Krien
6,935,064 B1 8/2005 Thompson
6,935,065 B1 8/2005 Oliver
6,945,441 B2 9/2005 Gates et al.
D515,614 S 2/2006 Speggiorin
7,066,365 B2 6/2006 Brown
7,066,435 B2 6/2006 Oddsen et al.
7,086,192 B2 8/2006 Deros
7,124,530 B1 10/2006 Clark
7,188,445 B2 3/2007 Lehman
D551,734 S 9/2007 Barker et al.
7,311,048 B2 12/2007 Kopala, Jr.
7,313,884 B2 1/2008 Eddins
7,415,790 B1 8/2008 Ruhland et al.
7,454,859 B2 11/2008 Buckner
7,493,719 B2 2/2009 Lackey
7,506,470 B2 3/2009 Pereksta
7,676,978 B2 3/2010 Marlatt
7,726,478 B2 6/2010 Potterfield et al.
7,770,319 B2 8/2010 McDonald
7,779,572 B2 8/2010 Potterfield et al.
7,784,212 B1 8/2010 Chilton
7,823,317 B2 11/2010 Potterfield et al.
7,845,267 B2 12/2010 Potterfield et al.
7,845,602 B1 12/2010 Young et al.
7,930,852 B1 4/2011 Hubbard, Jr.
7,946,071 B2 5/2011 Cauley
7,954,272 B2 6/2011 Potterfield et al.
7,958,663 B2 6/2011 Saunders, III
7,980,017 B2 7/2011 Harman, III
7,997,021 B2 8/2011 Cauley et al.
8,011,129 B2 9/2011 Cauley et al.
8,104,212 B2 1/2012 Potterfield et al.
8,104,214 B2 1/2012 Boord
8,132,351 B2 3/2012 Potterfield et al.
8,146,876 B1 4/2012 Young et al.
8,176,670 B2 5/2012 Boord
8,256,732 B1 9/2012 Young et al.
8,296,988 B2 10/2012 Yale et al.
8,297,565 B2 10/2012 McLinda
8,307,576 B1 11/2012 Bogart et al.
8,316,570 B2 11/2012 Potterfield et al.
8,316,572 B2 11/2012 Saunders, III
8,322,067 B2 12/2012 Boord
8,327,570 B2 12/2012 Potterfield et al.
8,356,442 B2 1/2013 Potterfield et al.
8,393,106 B2 3/2013 Cauley et al.
8,434,594 B2 5/2013 Zinsmeyer
8,464,460 B1 6/2013 Runyan
8,464,628 B2 6/2013 Potterfield et al.
8,469,326 B1 6/2013 Young et al.
8,516,733 B1 8/2013 Richey, Jr. et al.
8,539,709 B2 9/2013 Otto
8,544,202 B2 10/2013 Bastian, Jr.
8,549,786 B1 10/2013 Griffith
8,578,645 B2 11/2013 Cauley
8,590,440 B2 11/2013 Gallo
8,621,773 B2 1/2014 Morrow et al.
8,683,909 B1 4/2014 Copus
8,695,935 B1 4/2014 Kasbohm
8,714,508 B1 5/2014 Young et al.
8,813,407 B1 8/2014 Sargent et al.
8,894,024 B2 11/2014 Deros
8,931,193 B1 1/2015 Bogart et al.
8,931,201 B2 1/2015 Gianladis et al.
9,010,710 B1 4/2015 Young et al.
9,151,561 B2 10/2015 Morrow et al.
9,163,893 B1 * 10/2015 Gutierrez ..... F41A 23/02
9,200,858 B2 12/2015 Bull
9,200,859 B2 12/2015 Antell
9,279,535 B2 3/2016 Parrott
9,297,601 B2 3/2016 White
9,505,352 B2 11/2016 Fife
9,557,131 B1 1/2017 Antell
9,568,265 B2 2/2017 Bastian, Jr.
9,618,291 B1 4/2017 Henderson
9,625,229 B1 4/2017 Hilz
9,702,653 B2 7/2017 Cauley, Jr. et al.
9,746,268 B2 8/2017 Antell
9,772,158 B1 9/2017 Staton
9,797,673 B2 * 10/2017 Gutierrez ..... F41A 23/02
D802,885 S 11/2017 DeWeever
9,823,047 B2 11/2017 Lupher et al.
9,903,680 B2 2/2018 Linderwell
9,976,693 B1 5/2018 Delikat et al.
10,139,182 B2 11/2018 Duncan et al.
D837,923 S 1/2019 Gleick et al.
10,175,020 B2 1/2019 Newcomb
10,184,747 B1 1/2019 Courter
10,209,023 B1 * 2/2019 Stuart ..... F41A 23/18
D846,058 S 4/2019 Dennett

(56) References Cited

U.S. PATENT DOCUMENTS

| | | | | |
|---|---|---|---|---|
| 10,288,382 | B1 | 5/2019 | Pollock | |
| 10,317,162 | B2 | 6/2019 | Morrow et al. | |
| 10,352,645 | B1 | 7/2019 | Antell | |
| 10,415,921 | B1 | 9/2019 | Nousiainen | |
| 10,429,147 | B2 | 10/2019 | Williams et al. | |
| 10,474,013 | B2 | 11/2019 | Wynalda, Jr. et al. | |
| 10,514,225 | B2 | 12/2019 | Cauley, Jr. et al. | |
| 11,624,578 | B1 * | 4/2023 | Dallenbach | F41A 23/16 42/94 |
| 12,135,181 | B1 | 11/2024 | Hunger | |
| 2002/0184692 | A1 | 12/2002 | Mullis | |
| 2006/0254114 | A1 * | 11/2006 | Lehman | F41A 23/04 42/94 |
| 2009/0031744 | A1 | 2/2009 | D'Souza | |
| 2009/0223106 | A1 * | 9/2009 | Marlatt | F41A 23/02 42/94 |
| 2014/0352193 | A1 | 12/2014 | Bull | |
| 2016/0076846 | A1 | 3/2016 | Melancon | |
| 2017/0191783 | A1 * | 7/2017 | Gutierrez | F16M 13/022 |

* cited by examiner

SLIDING GUN REST SYSTEM AND METHOD OF USE

CROSS-REFERENCE TO RELATED APPLICATION

This application is a continuation-in-part of U.S. application Ser. No. 16/997,352 filed on Aug. 19, 2020, which is incorporated herein by reference.

FIELD OF THE INVENTION

The present invention relates generally shooting systems and methods, and more specifically, to a sliding gun rest system that fits in or near a window or similar opening in a blind or hut and allows a firearm to rest thereon and be positioned towards different directions with a natural and fluid movement.

DESCRIPTION OF RELATED ART

Shooting systems are well known in the art and are effective means to discharge projectiles such as bullets for hunting, self-defense and the like. For example, when hunting, a person will locate a target, take aim at it and discharge a firearm that will force a projectile towards the target. In some forms of hunting, a blind or stand is erected, and the hunter will wait for the target to come close to their location. While stands and holders for firearms have been developed, they commonly support the firearm as to require the person operating the firearm to move their position while the firearm remains generally still.

One of the problems associated with common shooting systems used in blinds is their limited use. For example, when the hunter is in a blind the firearm must be constantly at the ready. Holding the firearm in this position is tedious and tiring and the hunter's accuracy is negatively impacted. Attempts to relieve this deficiency have resulted in supports and stands that range from a pole to support the firearm to complex holders that both support and aim the firearm. Commonly, shooting systems intrude into the limited space of the blind which restricts their use through a single window, typically the forward-facing window. These shooting systems require that the firearm must be pivoted about a fixed point, this necessitates that the person that operates the firearm must move about the fixed point. While hunting, this movement could disturb the target and reduce the opportunity and the ability to aim and fire at it.

Accordingly, although great strides have been made in the area of shooting systems, many shortcomings remain.

BRIEF DESCRIPTION OF DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
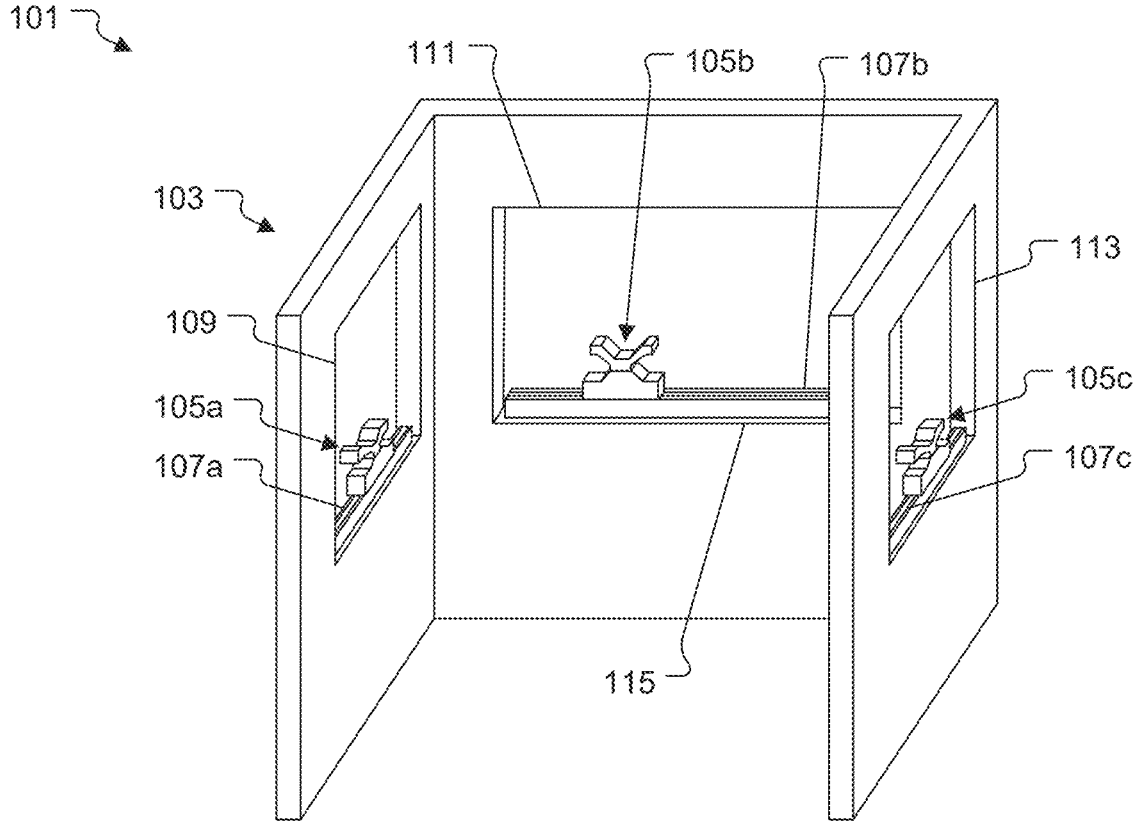
FIG. 1 is a back-isometric view of a sliding gun rest system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The system and method of use in accordance with the present application overcomes one or more of the above-discussed problems commonly associated with conventional shooting systems. Specifically, the present invention enables the rapid aiming of a firearm without the hunter moving their position and enables the use of the firearm out of multiple windows in a blind. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Referring now to the drawings wherein like reference characters identify corresponding or similar elements throughout the several views, FIG. 1 depicts a back-isometric view of a sliding gun rest system mounted in multiple windows of a blind, in accordance with a preferred embodiment of the present application. It will be appreciated that system 101 overcomes one or more of the above-listed problems commonly associated with conventional shooting systems.

In the contemplated embodiment, system 101 includes a shelter 103 with a first window 109, a second window 111 and a third window 113. Each window has a rest 105 slidingly attached to a rail 107 in the bottom or sill thereof. The rests 105 are configured to hold and support a firearm.

Figure 2:
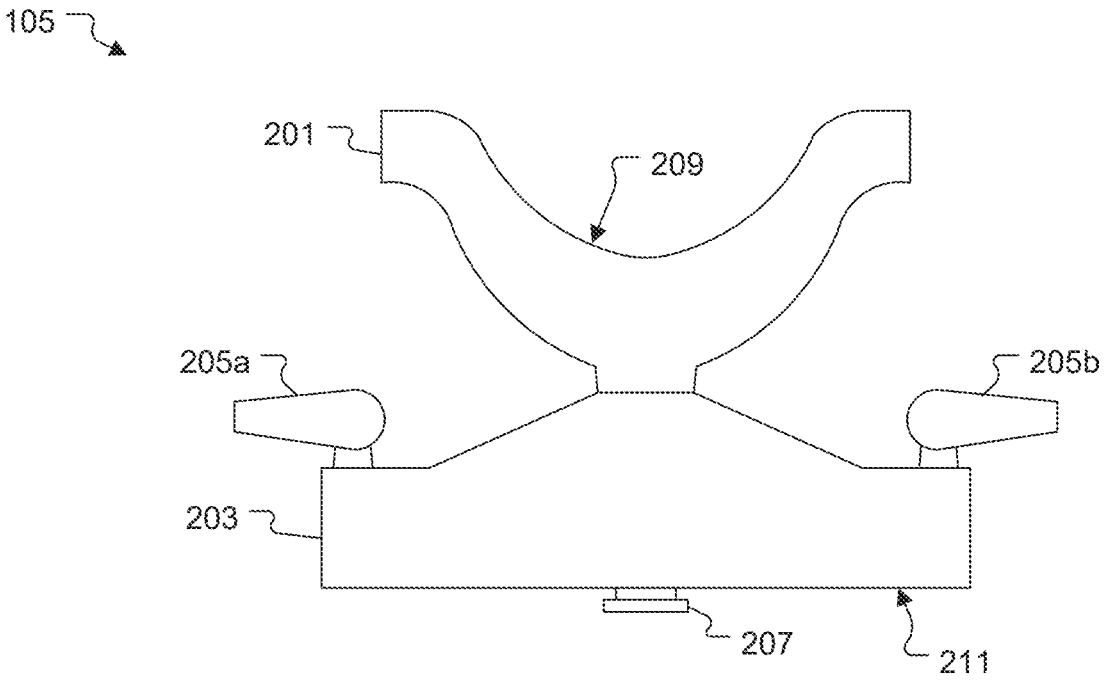
FIG. 2 is a front view of the rest of FIG. 1.
Figure 3:
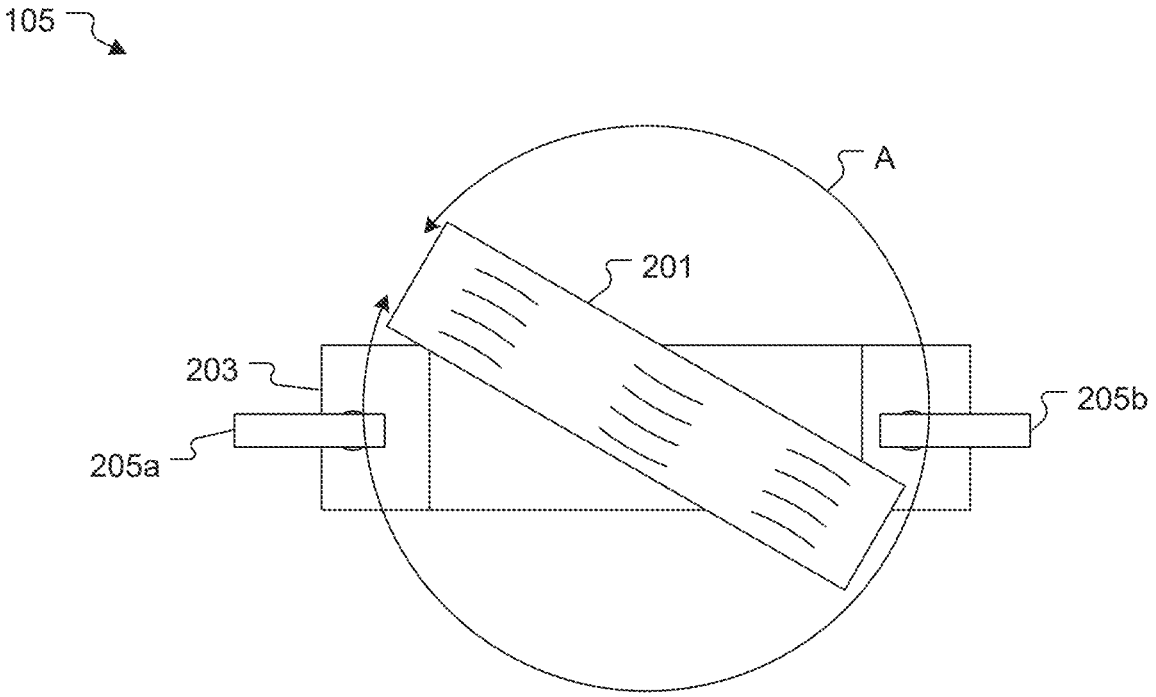
FIG. 3 is a top view of the rest of FIG. 1.

As depicted by FIG. 2, the rest 105 further includes a first body 201 with a concave upper surface 209. The first body is rotationally attached to a second body 203 and a slide 207 is attached to the bottom surface 211 of the second body 203. Restraints 205 are attached to the second body 203 and are configured to hold the rest 105 motionless with respect to the rail 107. As depicted by motion A of FIG. 3, the first body 201 rotates with respect to the second body 203.

Figure 4:
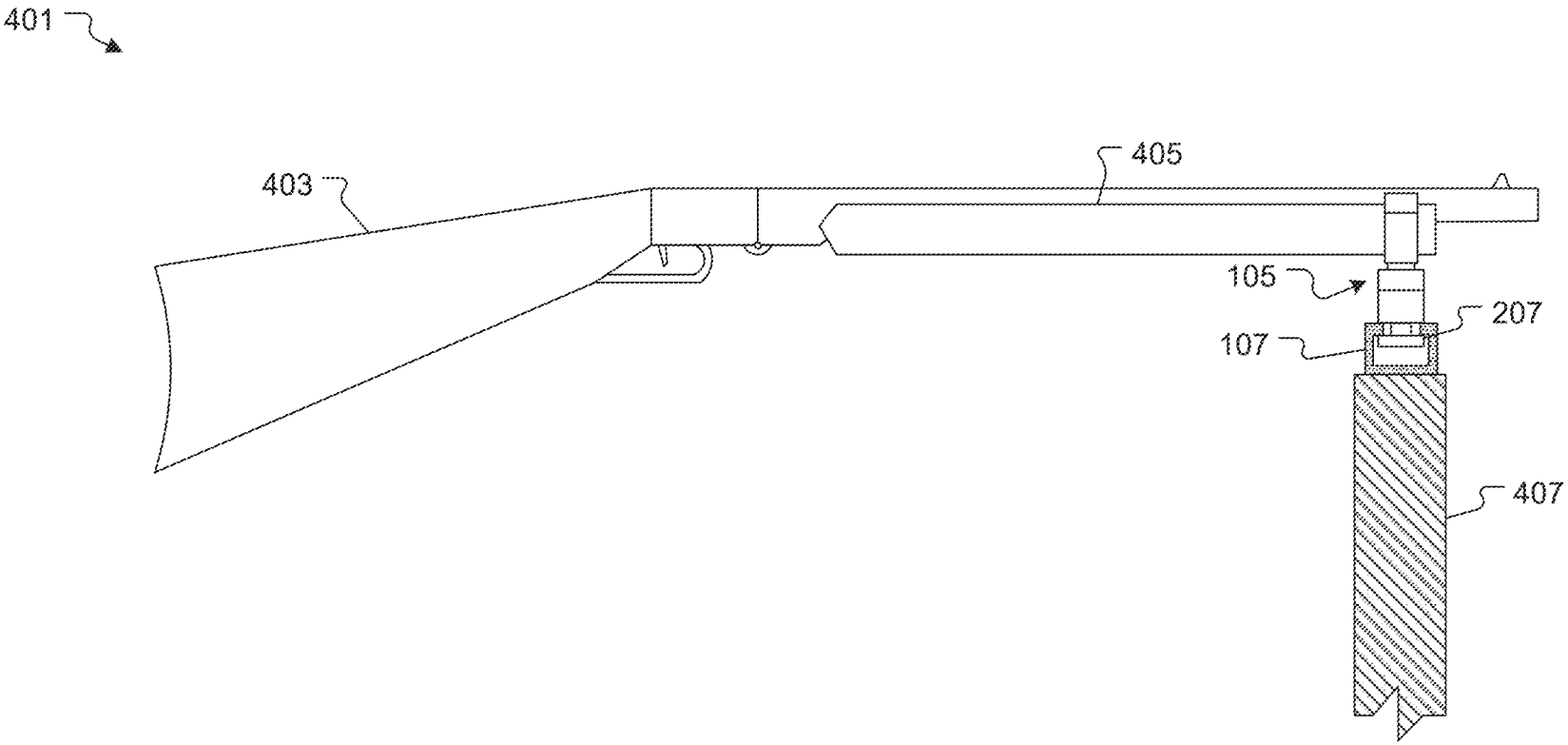
FIG. 4 is a cross-sectional side view of the system of FIG. 1 in use.

The use 401 of the system 101, as depicted by FIG. 4 includes a firearm 403 that is supported by the rest 105 via the forearm 405 or barrel. The slide 207 engages with the rail 107 that rests on wall 407. The slide 207 allows the rest 105 to move along rail 107. The hunter or user then aims the firearm 403 and the rest 105 moves to the corresponding position on the rail 107. As desired the restraints are used to prevent motion of the rest 105 or to stabilize the rest 105. The firearm 403 is then aimed and discharged.

It should be appreciated that one of the unique features believed characteristic of the present application is that the user does not move or reposition their body when aiming the firearm 403 as the rest 105 slides along the rail 107. Further, the user may remain seated and move the firearm 403 in the rest 105 while sliding along the rail 107

Figure 5:
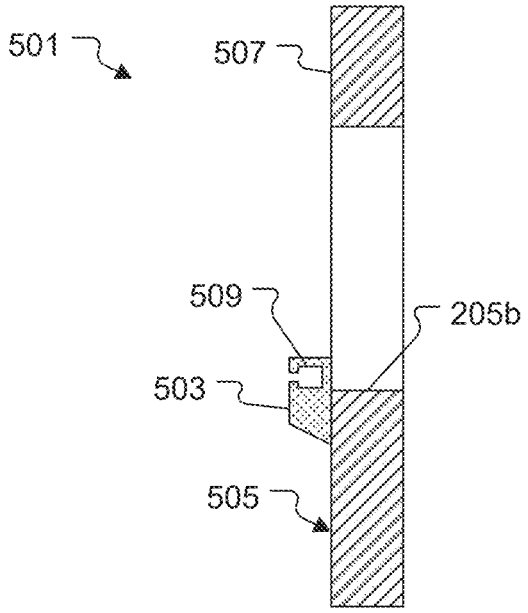
FIG. 5 is a cross-sectional side view of an alternative embodiment of the system of FIG. 1.
Figure 6:
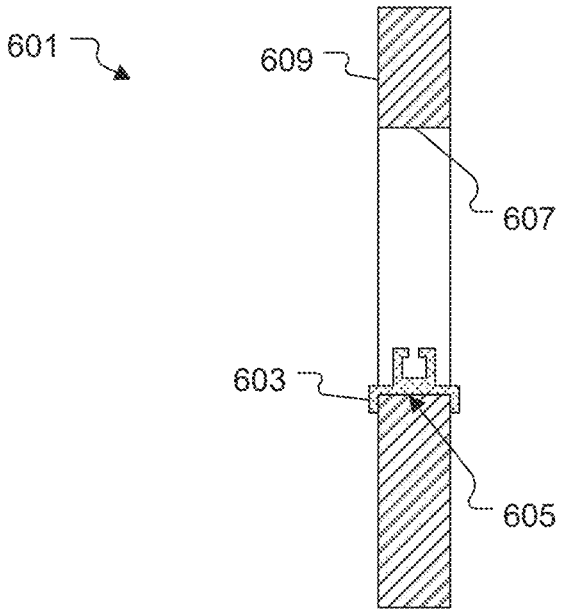
FIG. 6 is a cross-sectional side view of an alternative embodiment of the system of FIG. 1.

Referring now to FIGS. 5 and 6, alternative embodiments of the system 101 are depicted. While it has been depicted that the rail 107 is attached to the bottom of a window or cutout in a wall it is contemplated that in embodiment 501 the rail 503 is attached to the interior surface 505 of the wall 507 so that the firearm has access to the window 509. It is also contemplated that a track 509 faces the interior of the room, blind, or space. Further, as in embodiment 601, the rail 603 is attached over the bottom 605 of the window 607 or cutout in the wall 609. These examples are given to illustrate the concept of the invention and not to limit its scope. It will be understood that the rail could be attached anywhere so long as the firearm is able to be placed on the rest with access through the window, for example outside the blind attached to the outer wall.

Figure 7:
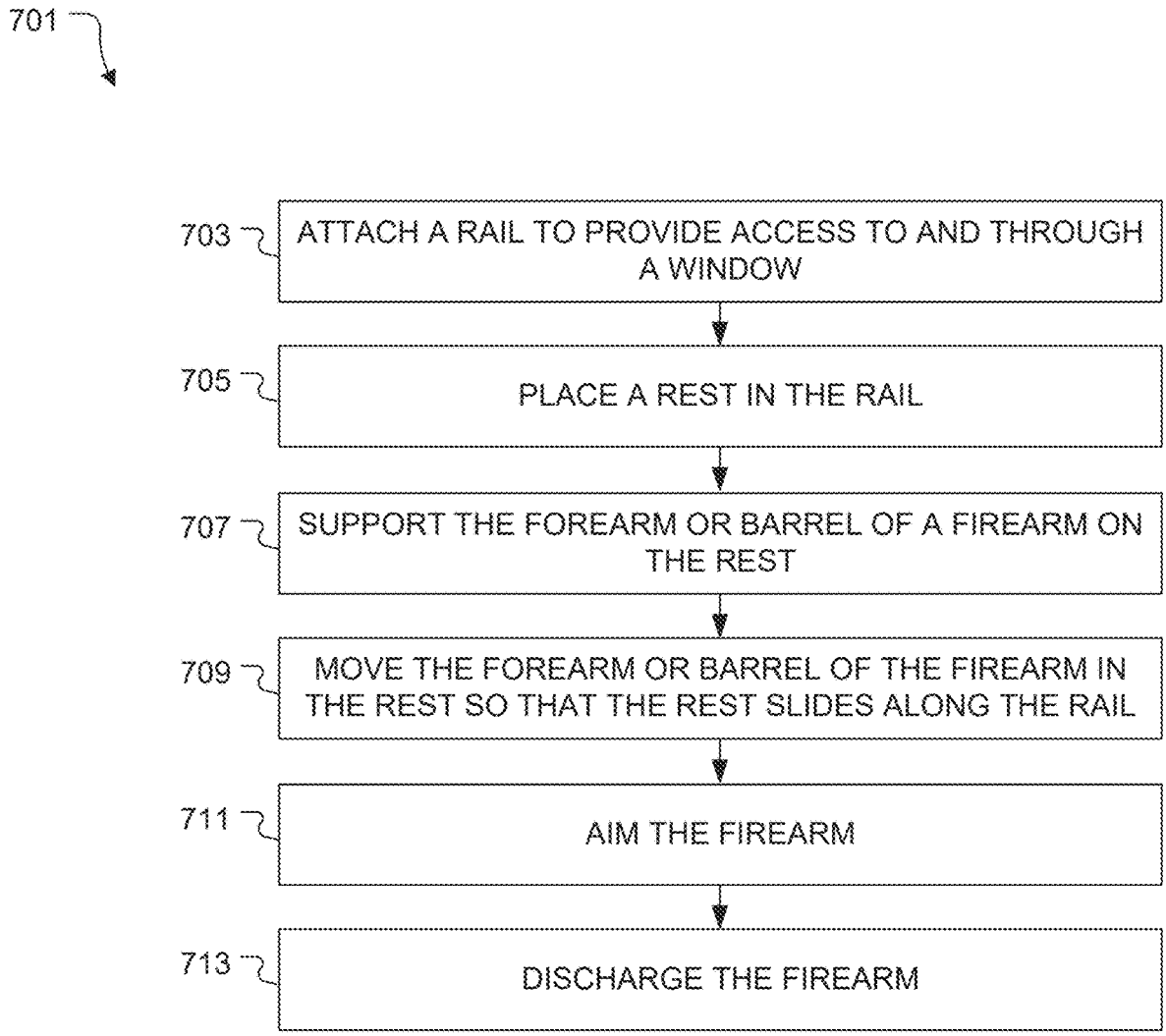
FIG. 7 is a flowchart of a method of supporting and aiming a firearm.

Referring now to FIG. 7, a method of supporting and aiming a firearm is depicted. Method 701 includes attaching a rail to provide access to and through a window 703, placing a rest in the rail 705, supporting the forearm or barrel of a firearm on the rest 707, moving the forearm or barrel of the firearm in the rest so that the rest slides along the rail 709, aiming the firearm 711 and discharging the firearm 713.

Figure 8:
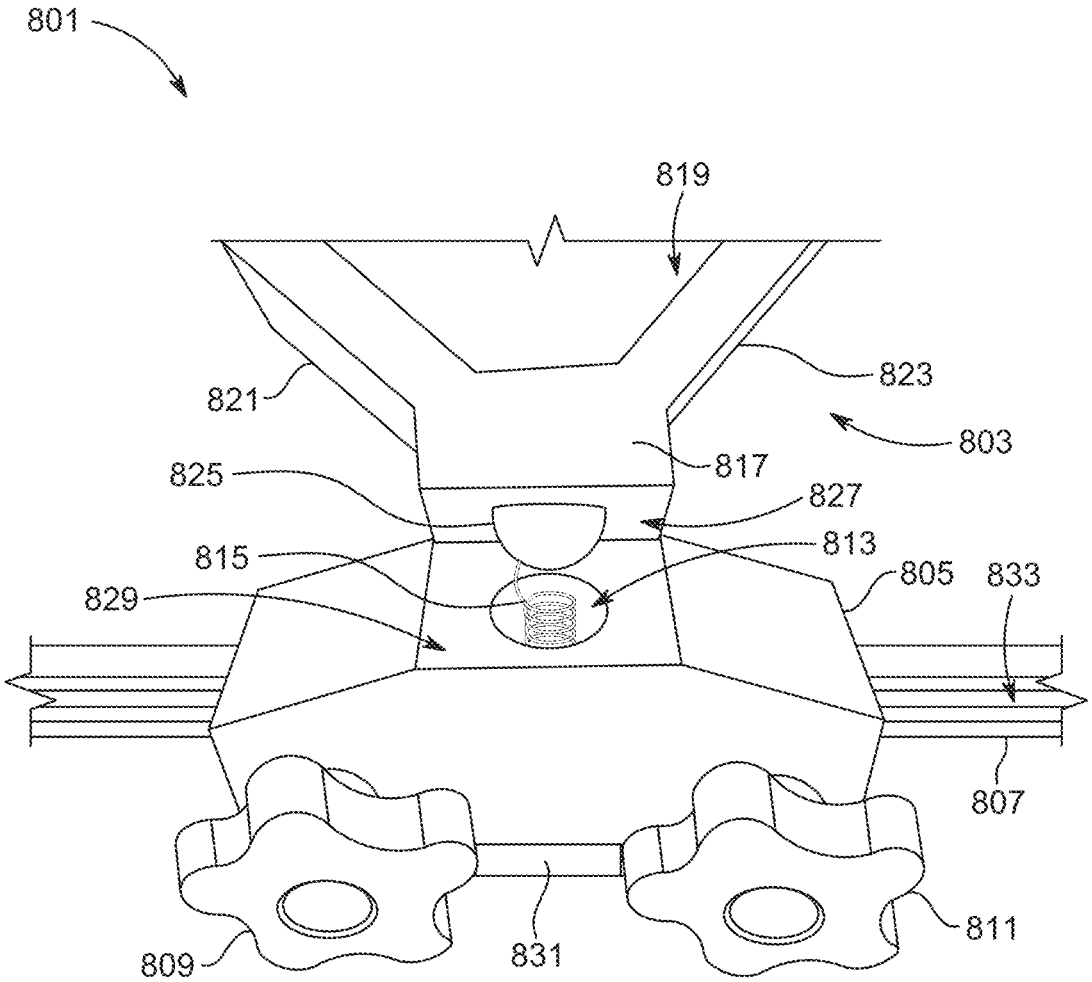
FIG. 8 is a top perspective view of a rest system in accordance with one preferred embodiment.
Figure 9:
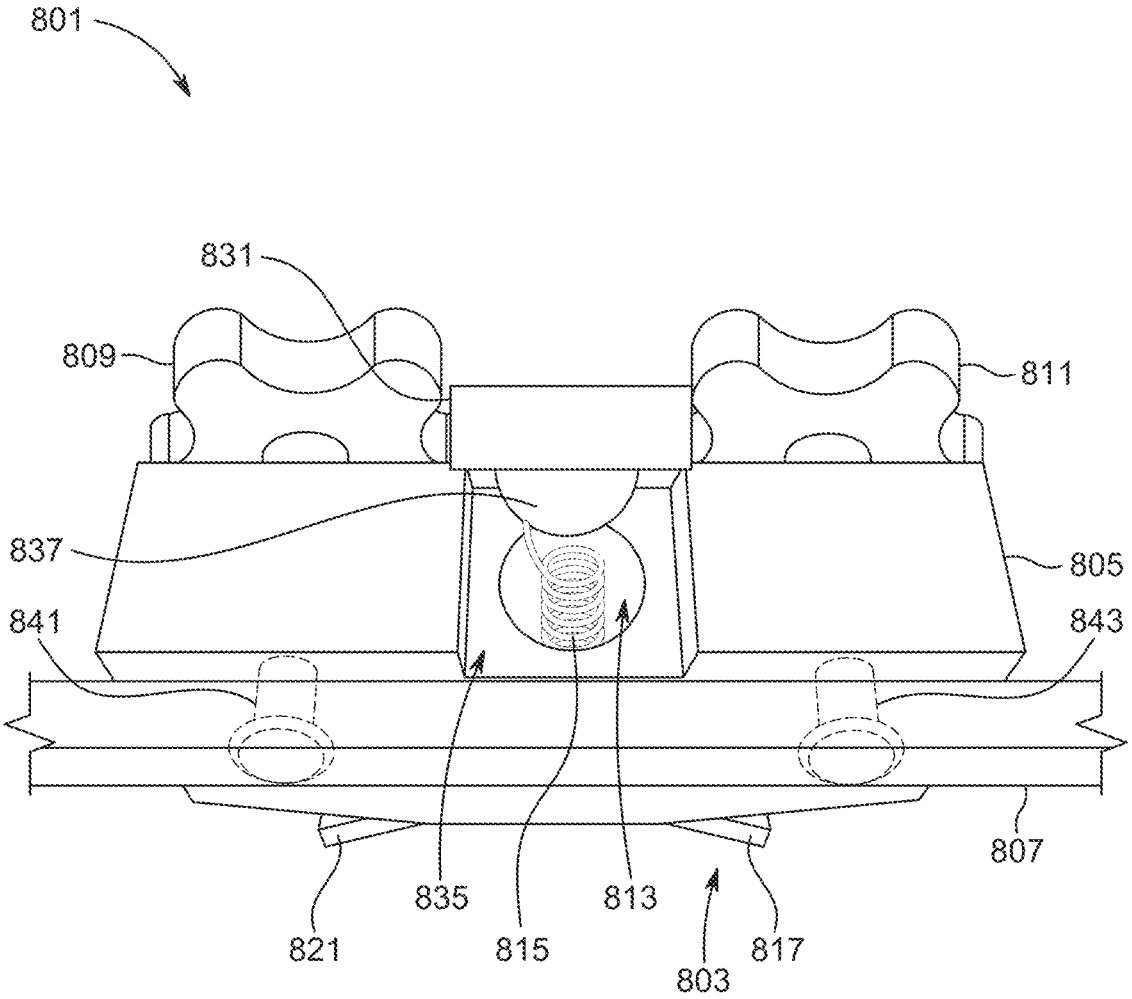
FIG. 9 is a bottom perspective view of a rest system in accordance with one preferred embodiment.
Figure 10:
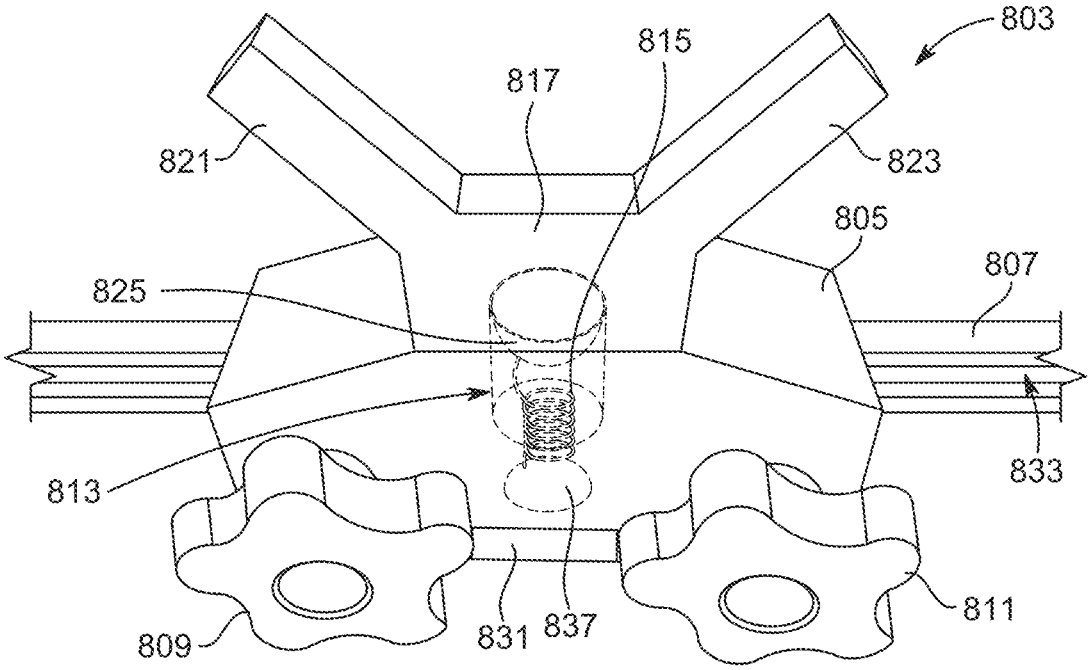
FIG. 10 is a front perspective view of a rest system in accordance with one embodiment of the present application.

FIGS. 8, 9 and 10 depict a rest system 801 for a rest that is configured to support a firearm. FIG. 8 illustrates a perspective view from the top front. FIG. 9 illustrates a perspective view from the bottom-back. FIG. 10 illustrates a front view.

In this embodiment, the rest system 801 includes a support cradle 803 supported by a slide body 805. The slide body 805 may be slidably engaged with the rail 807. The rail 807 may be attached to a structure, such as the blind discussed with FIG. 1. In some embodiments, the rail 807 may be directly attached or integrated into the structure. The rail 807 may alternatively be indirectly attached to the structure by alternative or intermediate connectors. The support cradle 803 is supported by the structure through the slide body 805 and rail 807.

In some embodiments, the support cradle 803 includes a body with a Y-shaped configuration formed by a first arm 821 and a second arm 823 extending from a center base 817. In some embodiments, the configuration of the support cradle 803 may form a U-shape, a V-shape or another shape configured to support another device. In the embodiment shown, the first arm 821, the second arm 823 and center base 817 create an opening 819 for a firearm, sight or other item to rest within.

In this embodiment, the center base 817 includes a bottom surface 827, which includes a semi-sphere or dome 825 protruding below the bottom surface 827. This dome 825 fits into an opening 813 in the slide body 805. The slide body 805 is shown with a top surface 829 around the opening 813. In some embodiments, the fitting between the dome 825 and the opening 813 is configured to allow the support cradle 803 to rotate relative to the slide body 805. In addition, the dome 825 is configured to allow the support cradle 803 to temporarily separate from the slide body 805 when a force is applied to the support cradle 803 and then to automatically return to its original position in the slide body 805. This configuration may protect the support cradle 803, the slide body 805, the rail 807 or other components from damage during a sudden force on the support cradle 803. For example, if a firearm is discharged while the firearm is in the support cradle 803, the recoil may cause a sudden shift in the support cradle 803. The design of the rest system 801 is configured to accommodate these forces without damaging the system.

In the embodiment shown, a spring 815 is attached to the dome 825 at the bottom of the support cradle 803. The spring 815 passes through the opening 813 and attaches to a second semi-sphere or dome 837 on the top of a base member 831. The spring 815 holds the top surface 829 of the slide body 805 to the bottom surface 827 of the support cradle 803 in a default state. In some embodiments, the spring 815 operates to keep the support cradle 803 with the slide body 805 when movement or recoil causes the support cradle 803 to shift relative to the slide body 805. In some embodiments, the dome may be a hemisphere or other protrusion allowing the rotation of the support cradle 803 to the slide body 805.

In some embodiments, the spring 815 may be replaced with an alternative device to hold the support cradle 803 in flexible connection with the slide body 805. For example, the support cradle 803 may be connected to the slide body 805 with an elastomeric material, such as rubber, plastic, neoprene, metal, nylon, fabric or other material, that allows the support cradle 803 to move relative to the slide body 805 while staying connected to the slide body 805. In some embodiments, the support cradle 803 and/or slide body 805 may be partially or entirely made of a flexible material. In such embodiments, the flexible material of the support cradle 803 or slide body 805 may extend to the connection and facilitate temporary displacement of the support cradle 803 relative to the slide body 805.

In addition, the spring 815 or other elastomeric component may connect to the domes 825 and 837 or other features to hold the pieces together in a flexible relationship. Similarly, the type of connect may vary depending on the materials selected and the design characteristics for the fitting between the support cradle 803 and the slide body 805. In some embodiments, the elastomeric component may be integrated with one or more of the support cradle 803, the slide body 805 or the base member 831.

In the embodiment shown, the slide body 805 has rail fittings including a first slide 841 and a second slide 843 that extend from the back of the slide body 805. The slides 841 and 843 may fit within a channel 833 in the rail 807 to hold the slide body 805 to the rail 807 in a slidable engagement. The channel 833 may form a C-shape cross-section with the opening facing the slide body 805. The slides 841 and 843 have a post extending to a larger head or cap that fits within the channel 833. The post may be smaller in diameter than the opening in the C-shape with the head larger than the opening in the C-shape to keep the slides 841 and 843 in the channel 833. In some embodiments, the head or cap of the slides 841 and 843 may be replaced by a roller or wheel. The roller may fit within the C-shaped channel and allow the slide body 805 to roll in the rail 807.

In some embodiments, one or both ends of the rail 807 may be open to allow a user to attach the slide body 805 to the rail 807 by guiding the slides 841 and 843 cap into the end opening of the C-shaped channel 833. In alternative embodiments, a section of the rail 807 may include larger gaps to accommodate the caps of the slides 841 and 843.

In some embodiments, the slide body 805 includes a first knob 809 and a second knob 811. The knobs 809 and 811 may be used to limit or allow movement of the slide body 805. In some embodiments, the knobs 809 and 811 may be connected to the slides 841 and 843. During operation, rotating the knobs 809 and 811 may move the slides 841 and 843 from a locked or limited position to a free or movable position. For example, a user may tighten the slide 843 by rotating knob 811 to limit movement of the slide body 805. Tightening the slide 843 may cause the cap or head of the slide 843 to contact the edges of the C-shaped channel 833 creating a friction to limit movement of the slide body 805. In another embodiment, the knob 809 or the knob 811 may engage another locking component to limit movement of the slide body 805 relative to the rail 807.

FIG. 10 illustrates the rest system 801 in a default position instead of the flexed position shown in FIG. 8. In the default position, the support cradle 803 is abutting the slide body 805 based on the tension provided by the spring 815 in the embodiment shown. As discussed, the rest system 801 may transition from the default position into a flexed position (see FIG. 8) or a rotated position, with the support cradle 803 rotated relative to the slide body 805, based on use of the rest system 801. For example, a user with a firearm in the opening 819 of the support cradle 803 may shift the rest system 801 to a different angle from the user by sliding the rest system 801 along the rail 807. When the rest system 801 shifts from the user's perspective, the support cradle 803 may rotate relative to the slide body 805 to keep the support cradle 803 approximately perpendicular to the firearm's barrel based on the angle and the user's location relative to the position on the rail 807. As another example, the support cradle 803 may transition from the default position to the flexed position when a user discharges a firearm resting in the opening 819. This transition may be due to the recoil of the firearm and friction or contact against the support cradle 803 pulling the support cradle 803 toward the user while the slide body 805 remains in place on the rail 807. This flex system may protect the slide body 805, rail 807 and/or a supporting structure from sudden impact effects of the firearm discharging.

Figure 11:
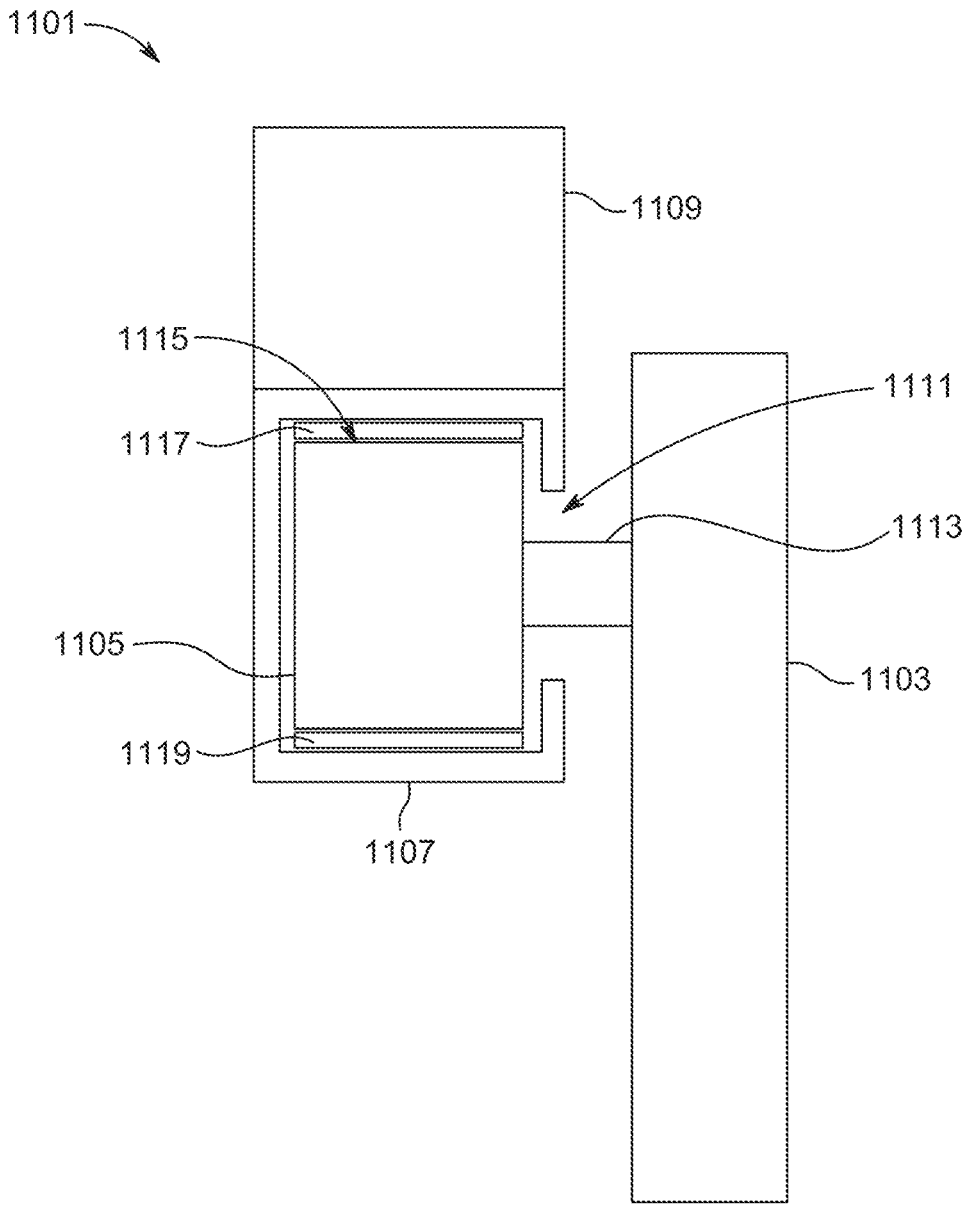
FIG. 11 is a cross-sectional view of a sliding support rest in accordance with one embodiment of the present application.

FIG. 11 illustrates a cross-sectional view of a sliding support system 1101. In this embodiment, the sliding support system 1101 includes a rail 1105 attached to a support structure 1103 by a connection member 1113. In some embodiments, the connection member 1113 may be a series of posts or blocks connecting to the rail 1105 and the support structure 1103. In other embodiments, the connection member 1113 may extend the length of the rail 1105. The connection member 1113 creates a space between the rail 1105 and the support structure 1103.

The sliding support system 1101 also includes a slide body 1107 attached to a rest 1109, or support cradle. In this embodiment, the slide body 1107 may have a rail fitting configured with a C-shaped channel with an opening 1111 towards the support 1103. The opening 1111 fits around the connection member 1113. The channel of the slide body 1107 fits around the rail 1105 and may slide along a top surface 1115 of the rail 1105. The C-shape channel combined with the rail 1105 that is taller than the opening 1111 of the C-shape may keep the slide body 1107 engaged with the rail 1105. In some embodiments, the slide body 1107 may be removable from the rail 1105 by sliding the slide body 1107 from the end of the rail 1105. In some embodiments, the rail 1105 may include removal locations designed to allow a user to remove the slide body 1107 from the rail 1105. For example, the rail 1105 may include a section with a reduced height that is less than the opening 1111, which allows the slide body 1107 to be removed.

In some embodiments, the slide body 1107 may include a top pad 1117 and/or a bottom pad 1119. In some embodiments, the pads 1117 and 1119 may create additional friction between the slide body 1107 and the rail 1105 to hold the slide body 1107 in place without a mechanical brake or other locking feature. In addition, the pads 1117 and 1119 may be selected to minimize or limit noise while sliding the slide body 1107. As an example, the pads 1117 and 1119 may be a fabric material, such as felt, that creates additional friction against a metal rail 1105.

In some embodiments, the pads 1117 and 1119 may be selected and designed to reduce friction during movement to allow ease of movement when sliding the slide body 1107 along the rail 1105 while increasing friction when the slide body 1107 is not moving, which may increase the static engagement between the rail 1105 and the slide body 1107. For example, a textured nylon may allow smooth movement during motion. When the motion stops, the textured features may engage the opposing material to create increased friction in the static position.

Those skilled in the art will recognize that the pads may be any material that aids in holding position, easing sliding, reducing noise or providing other benefits to the movable slide system. The pad materials may include rubbers, nylons, plastics, metals, woods, fabrics or other materials selected for the preferred attributes and the corresponding component combinations. In addition, the design and configuration of the materials and the texture design may be used to manage the friction in different circumstances. In addition, some embodiments may incorporate mechanical components, such as rollers, bearings or other components, to further manage the sliding and retaining of a position between the slide body 1107 and the rail 1105.

In some embodiments, one or both of the pads 1117 and 1119 may be attached to the rail 1105. Some embodiments may have corresponding pads attached to both the rail 1105 and the slide body 1107. In yet other embodiments, only one pad on the top or on the bottom may be used to manage the friction, noise or other desired attribute.

Figure 12:
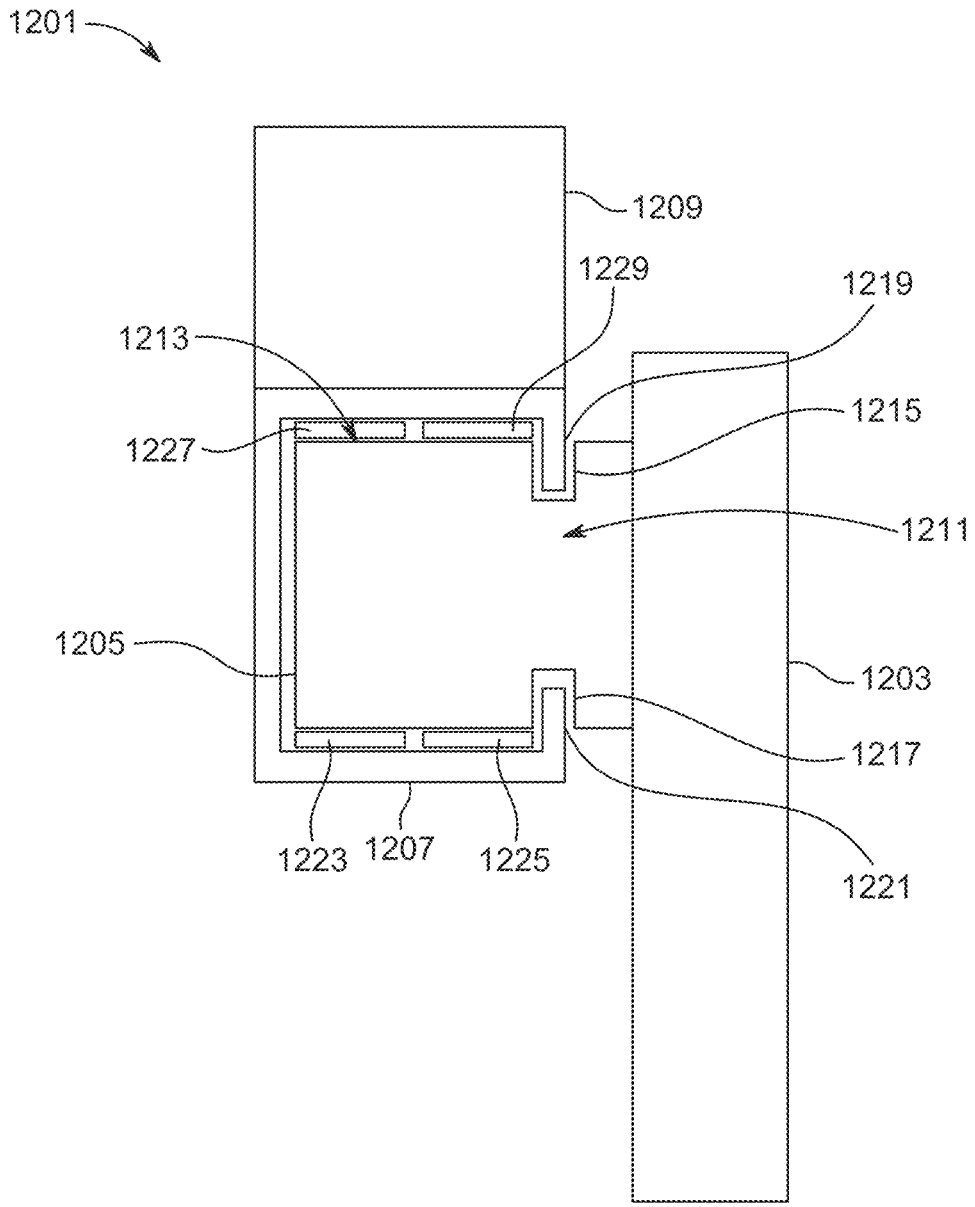
FIG. 12 is a cross-sectional view of a sliding support rest in accordance with one embodiment of the present application.

FIG. 12 illustrates a cross-sectional view of another sliding support system 1201. In this embodiment, the sliding support system 1201 includes a rail 1205 attached to a support structure 1203, such as a hunting blind. In this embodiment, the rail 1205 includes a bottom channel 1217 and a top channel 1219 spaced from the support structure 1203. These channels 1217 and 1219 extend along the rail 1205.

The sliding support 1201 system also includes a slide body 1207 attached to a rest 1209. As discussed herein, the rest 1209 may be a support cradle, mount or other support for a firearm, sight or other item. In this embodiment, the slide body 1207 may have a rail fitting configured with a C-shaped channel with an opening 1211 towards the support structure 1203. The opening 1211 is between top prong 1219 and bottom prong 1221 of the C-shaped channel. These prongs 1219 and 1221 may be any type of protrusion or series of protrusions corresponding to the channels 1215 and 1217 in the rail 1205. The opening 1211 fits around the rail 1205 with the prongs 1219 and 1221 within the channels 1215 and 1217. The slide body 1207 may slide along a top surface 1215 of the rail 1205. The C-shape channel with prongs 1219 and 1221 combined with the channels 1215 and 1217 set into the rail 1205 may keep the slide body 1207 engaged with the rail 1205. In some embodiments, the slide body 1207 may be removable from the rail 1205 by sliding the slide body 1207 from the end of the rail 1205. In some embodiments, the rail 1205 may include removal locations designed to allow a user to remove the slide body 1207 from the rail 1205. For example, the rail 1205 may include a section with the channels 1215 and 1217 curving from an interior of the rail 1205 to the exterior of the rail 1205, which allows the slide body 1207 to be removed by directing the prongs 1219 and 1221 along this exit section of the rail 1205.

In some embodiments, the slide body 1207 may include a first top pad 1227, a second top pad 1229, a first bottom pad 1223 and/or a second bottom pad 1225. In some embodiments, the pads 1223-1229 may create additional friction between the slide body 1207 and the rail 1205 to hold the slide body 1207 in place without a mechanical brake, lock or other restraint feature. In addition, the pads 1223-1229 may be selected to minimize or limit noise while sliding the slide body 1207.

In some embodiments, the pads 1223-1229 may be selected and designed to reduce friction during movement to allow ease of movement when sliding the slide body 1207 along the rail 1205 while increasing friction when the slide body 1207 is not moving, which may increase the static engagement between the rail 1205 and the slide body 1207. In this embodiment, the pads 1223-1229 may be designed from a compressible material, such as a soft rubber, fabric, plastic or other material, or may have a compressible design, such as an air-filled foam, balloon, or other design. When moving the slide body 1207, the pads 1223-1229 may allow low friction sliding. When the slide body 1207 is at rest, the weight of the slide body 1207 and rest 1209, along with any supported item, may cause the pads 1223-1229 to compress and create an increased friction to restrain movement. In the embodiment shown, the space between the top pads 1227 and 1229 and the space between the bottom pads 1223 and 1225 may provide additional space for compression.

In some embodiments, one or more pads 1223-1229 may be attached to the rail 1205. Some embodiments may have corresponding pads attached to both the rail 1205 and the slide body 1207. In yet other embodiments, the rest system 1201 may use an alternate number of pads, different pad designs, different pad materials and/or alternative restraint systems.

Figure 13:
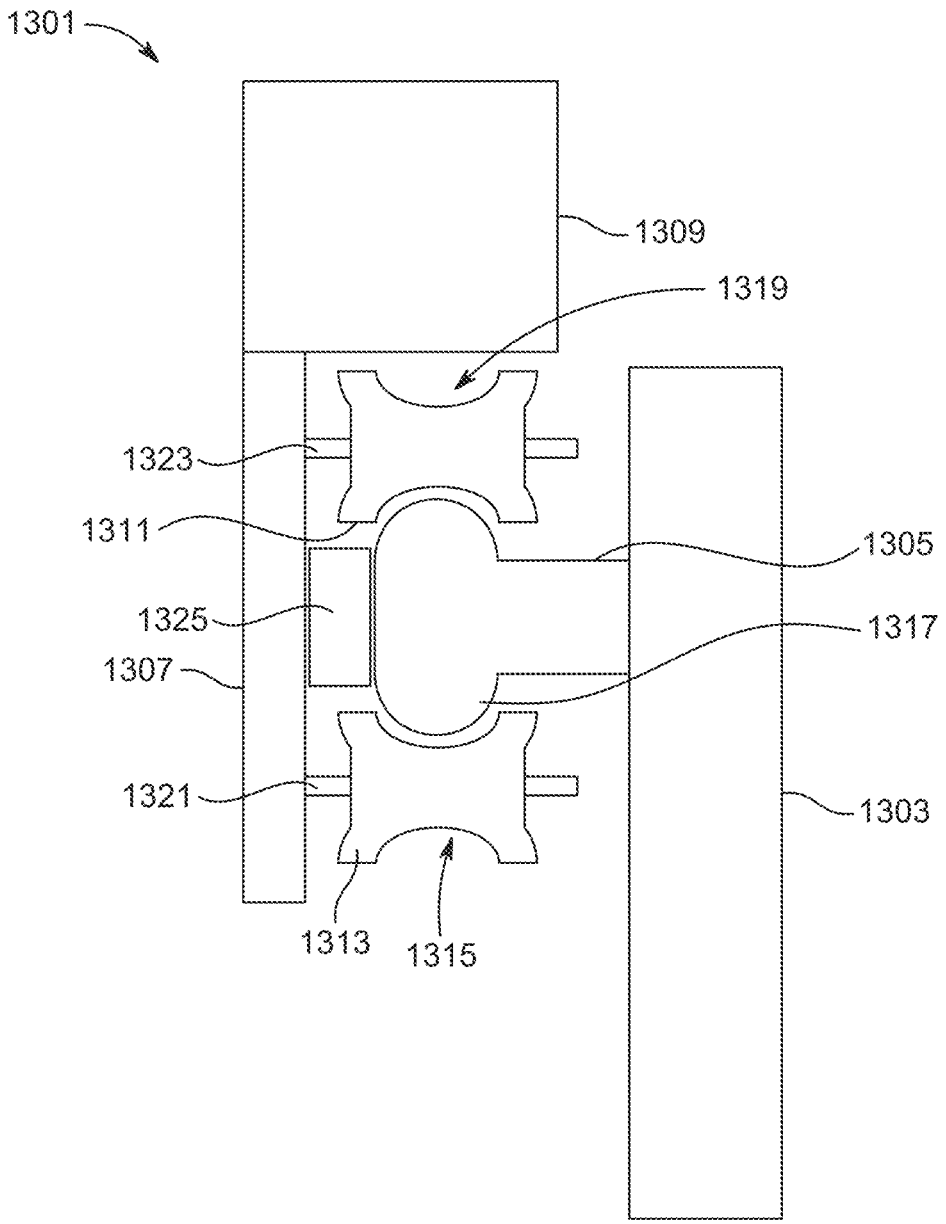
FIG. 13 is a cross-sectional view of a sliding support rest in accordance with one embodiment of the present application.

FIG. 13 illustrates a cross-sectional view of another support system 1301. In this embodiment, the support system 1301 includes a rail 1317 attached to a support structure 1303 by a connection member 1305. In some embodiments, the connection member 1305 may be a series of posts or blocks connecting to the rail 1317 and the support structure 1303. In other embodiments, the connection member 1305 may extend the length of the rail 1317. The connection member 1305 creates a space between the rail 1317 and the support structure 1303. In some embodiments, the rail 1317 may have a shape configured to correspond with additional components. In the embodiment shown, the rail 1317 has an oblong oval shape with the longer axis aligned approximately vertically.

The support system 1301 also includes a movable body 1307 attached to a rest 1309. The rest 1309 may be any item support component, such as the support cradles and rests discussed herein. In this embodiment, the movable body 1307 may have a rail fitting configured with a top roller 1311 and a bottom roller 1313 attached to the movable body 1307 frame by top axle 1323 and bottom axle 1321 respectively. Embodiments of the movable body 1307 may have sets of rollers 1311 and 1313 aligned to provide support on the rail 1317. For example, the movable body 1307 may have a pair of top rollers 1311 and a pair of bottom rollers 1313. As another example, the movable body 1307 may have two top rollers 1311 and a single bottom roller 1313 aligned between the two top rollers 1311. As those skilled in the art will appreciate, the plurality of rollers may be used to limit the tilt of the movable body 1307 by spreading the supporting features.

The rollers 1311 and 1313 have concave surfaces as indicated by arrows 1315 and 1319. These concave surfaces 1315 and 1319 correspond to a convex surface of the rail 1317. In some embodiments, the convex and concave components may be inverted, wherein the rollers 1311 and 1313 have convex wheels and the rail 1317 has corresponding concave channels. In some embodiments, the corresponding shapes may vary. For example, protruding angles may correspond to indented matching angles.

In some embodiments, the corresponding concave rollers 1311 and 1313 with the convex oval rail 1317 may keep the movable body 1307 engaged with the rail 1317. In some embodiments, the movable body 1307 may be removable from the rail 1317 by sliding the movable body 1307 from the end of the rail 1317. Embodiments of the rail 1317 may include removal locations designed to allow a user to remove the movable body 1307 from the rail 1317.

In some embodiments, the movable body 1307 may include a pad 1325, which is shown to the side of the rail 1317. The pad 1325 may create additional friction between the movable body 1307 and the rail 1317 to hold the movable body 1307 in place without a mechanical brake or other locking feature. In addition, the pad 1325 may be selected to minimize or limit noise while rolling the movable body 1307. As an example, the pad 1325 may be a fabric material, such as felt, that creates additional friction against a metal rail 1317.

In some embodiments, the pad 1325 may be selected and designed to reduce friction during movement to allow ease of movement when rolling the movable body 1307 along the rail 1317 while increasing friction when the movable body 1307 is not moving, which may increase the static engagement between the rail 1317 and the movable body 1307. In some embodiments, the pad 1325 may be attached to the rail 1317. Some embodiments may have corresponding pads attached to both the rail 1317 and the movable body 1307. In some embodiments, the support system 1301 may include more than one pad 1325.

Figure 14:
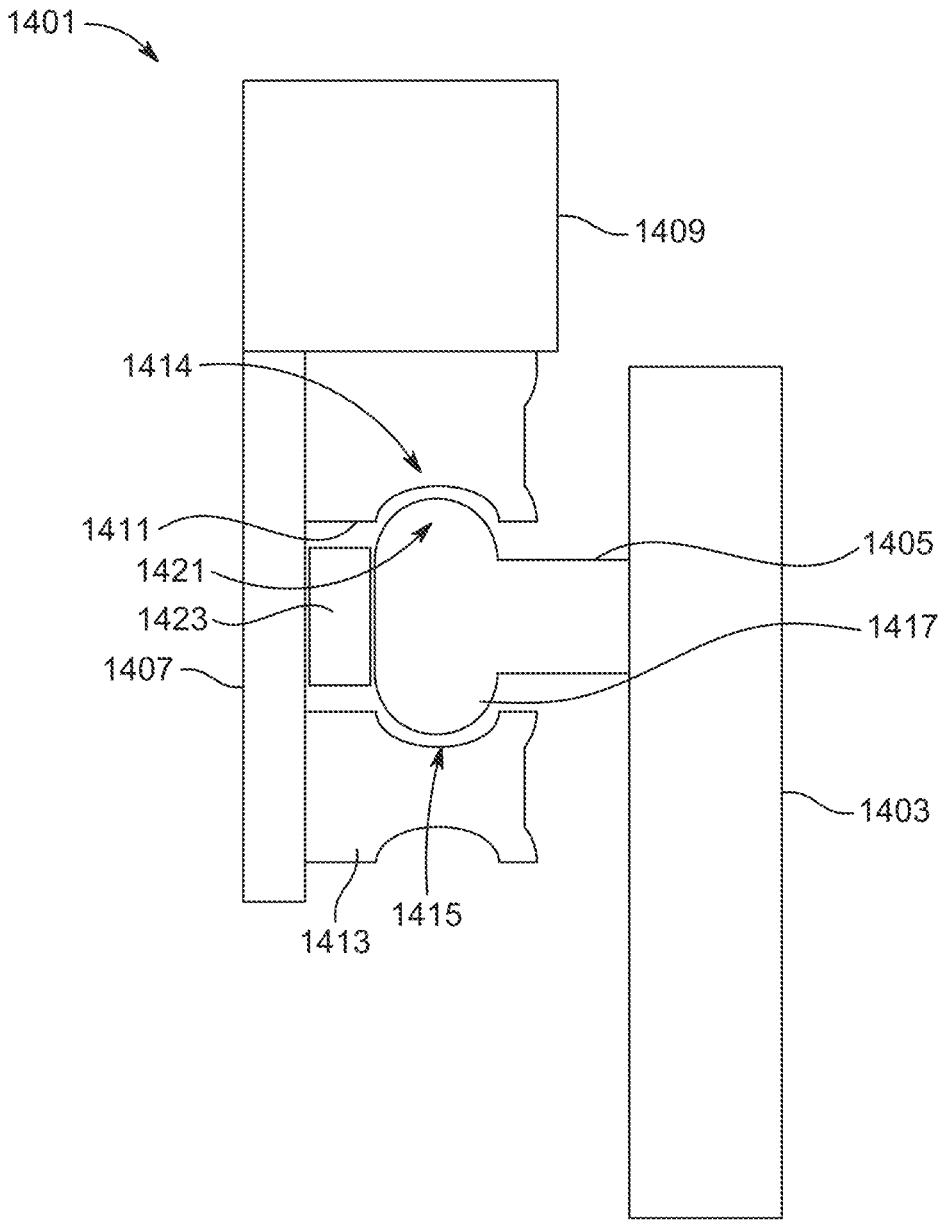
FIG. 14 is a cross-sectional view of a sliding support rest in accordance with one embodiment of the present application.

FIG. 14 illustrates a cross-sectional view of another support system 1401. In this embodiment, the support system 1401 includes a rail 1417 attached to a support structure 1403 by a connection member 1405. In some embodiments, the connection member 1405 may be a series of posts or blocks connecting to the rail 1417 and the support structure 1403. In other embodiments, the connection member 1405 may extend the length of the rail 1417. The connection member 1405 creates a space between the rail 1417 and the support structure 1403. In the embodiment shown, the rail 1417 has an oblong oval shape with the longer axis aligned approximately vertically.

The support system 1401 also includes a movable body 1407 attached to a rest 1409. The rest 1409 may be any item support component, such as the support cradles and rests discussed herein. In this embodiment, the movable body 1407 may have a rail fitting configured with a top slide 1411 having a convex fitting 1414 and a bottom slide 1413 having a convex fitting 1415. These concave fittings 1414 and 1415 correspond to convex surfaces 1421 of the rail 1417. In some embodiments, the convex and concave components may be inverted, wherein the slides 1411 and 1413 have convex surface fittings and the rail 1417 has corresponding concave channels. In some embodiments, the corresponding shapes may vary.

In some embodiments, the corresponding concave surfaces 1414 and 1415 of the slides 1411 and 1413 with the convex surfaces 1421 of the rail 1417 may keep the movable body 1407 engaged with the rail 1417. In some embodiments, the movable body 1407 may be removable from the rail 1417 by sliding the movable body 1407 from the end of the rail 1417. Embodiments of the rail 1417 may include removal locations designed to allow a user to remove the movable body 1407 from the rail 1417.

In some embodiments, the movable body 1407 may include a pad 1423, which is shown to the side of the rail 1417. The pad 1423 may create additional friction between the movable body 1407 and the rail 1417 to hold the movable body 1407 in place without a mechanical brake or other locking feature. In addition, the pad 1423 may be selected to minimize or limit noise while rolling the movable body 1407. As an example, the pad 1423 may be a fabric material, such as felt, that creates additional friction against a metal rail 1417.

In some embodiments, the pad 1423 may be selected and designed to reduce friction during movement to allow ease of movement when rolling the movable body 1407 along the rail 1417 while increasing friction when the movable body 1407 is not moving, which may increase the static engagement between the rail 1417 and the movable body 1407. In some embodiments, the pad 1423 may be attached to the rail 1417. Some embodiments may have corresponding pads attached to both the rail 1417 and the movable body 1407. In some embodiments, the support system 1401 may include more than one pad 1423.

Figure 15:
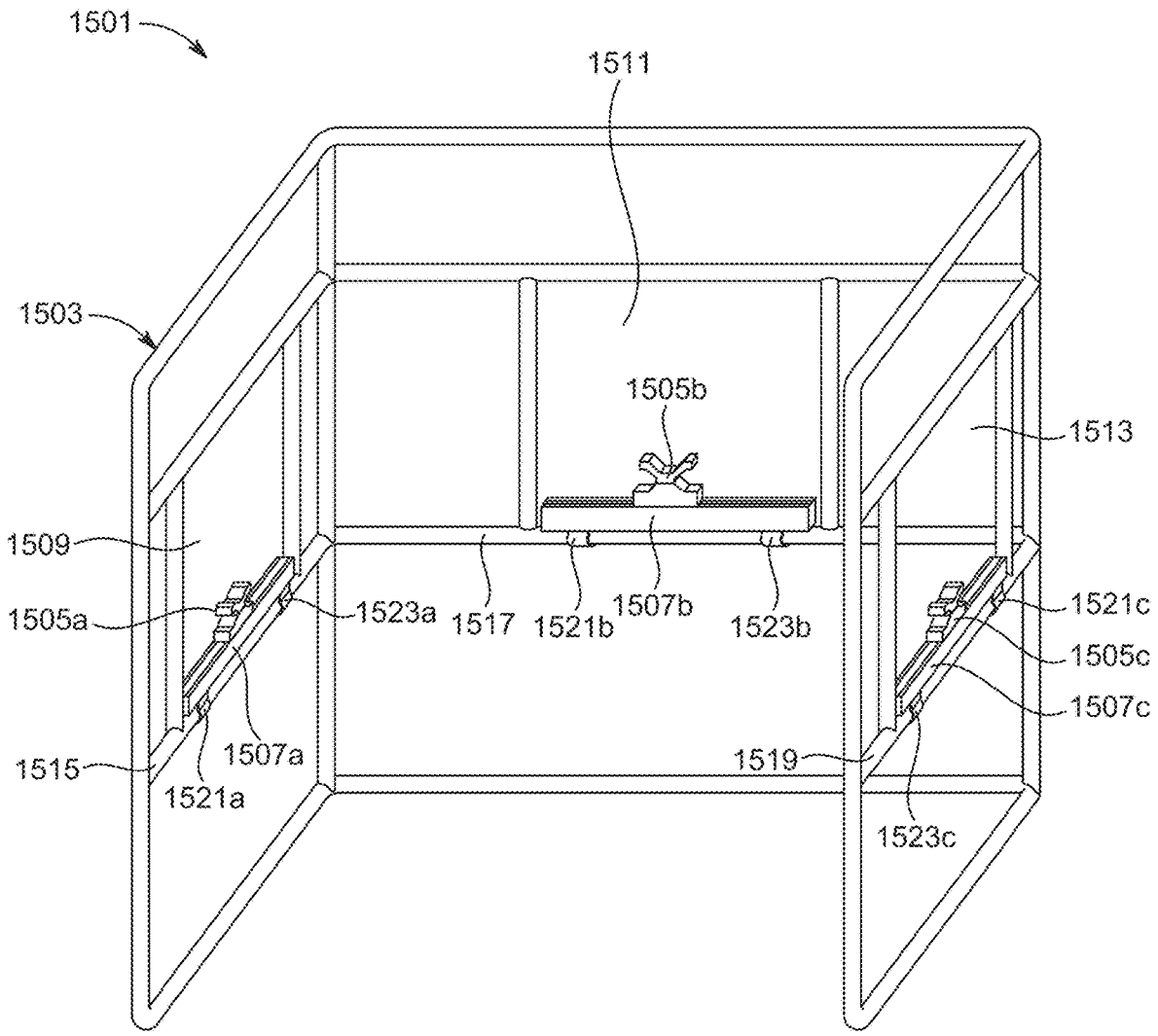
FIG. 15 is a perspective view of a tubular structure including a series of support rests in accordance with one embodiment of the present application.

FIG. 15 shows a perspective view of a support system 1501. The support system 1501 includes a structure 1503 including a series of support rest systems. The structure may be a shelter, a blind, a tent, a platform or another structure. In the embodiment shown, the structure 1503 is a tubular design that is built from a series of frame poles connected to form the shelter design. The structure 1503 may also include a series of wall panels, coverings, canvases or other materials to enclose all or portions of the structure 1503.

Some embodiments of the structure 1503 may include windows 1509, 1511 and 1513 of the structure 1503. Those skilled in the art will recognize that the windows 1509, 1511 and 1513 may be any cutout or opening in a wall allowing view or movement through the wall of the structure. In this embodiment, each of the support rest systems are depicted positioned within the windows 1509, 1511 and 1513 of the structure 1503. In the embodiment shown, the structure 1503 includes a series of frame poles 1515, 1517 and 1519, which define the bottom of each window 1509, 1511 and 1513.

In this embodiment, each of the support rest systems includes a movable support rest 1505*a*, 1505*b* and 1505*c* attached to a rail 1507*a*, 1507*b* and 1507*c* that extends within the corresponding frame of the window 1509, 1511 or 1513. Each rail 1507 is attached to the corresponding frame pole 1515, 1517 or 1519. In the embodiment shown, the rails 1507 are connected to the frame poles 1515, 1517 and 1519 by pairs of mechanical attachments 1521*a* and 1523*a*, 1521*b* and 1523*b*, and 1521*c* and 1523*c*. The mechanical attachments 1521 and 1523 may be configured to fit around the frame poles 1515, 1517 and 1519 and secure the rail 1507 in place. In some embodiments, the mechanical attachments 1521 and 1523 may have an angular or curved section to grip the frame pole 1515, 1517 or 1519 when an opposing bolt, pin, hinge or other feature is tightened to apply force.

In some embodiments, one or more rails 1507 may be configured to allow alternative connections to the structure 1503. For example, a rail 1507 may include mechanical attachments extending from along the rail 1507, and the mechanical attachments may attach to frame poles at the sides of the window. In some embodiments, the rails 1507 may include fittings to allow a user to install the mechanical attachments to the ends, the bottom or the top of the windows 1509, 1511 and 1513 to correspond with the design of the structure.

In some embodiments, the rails 1507 and the mechanical attachments 1521 and 1523 may be configured to hold the rails 1507 on the inside of or the outside of the windows 1509, 1511 and 1513. In such embodiments, the rails 1507 may be configured to support the movable support rest 1505 in a vertical position to support an item pointed through the window 1509, 1511 or 1513.

In some embodiments, the mechanical attachments 1521 and/or 1523 may be a pipe strap, bolt, U-bolt, snap-fit, clamp or other connector, designed to attach the rail 1507 to the frame pole 1515, 1517 and/or 1519. In some embodiments, the support rest systems may use different assemblies to attach to the structure 1503. For example, the rail 1507*a* may be attached to the frame pole 1515 by mechanical attachments 1521*a* and 1523*a* using tension grips, such as a spring biased design having a material and/or texture to hold the mechanical attachments 1521*a* and 1523*a* to the frame pole 1515. In addition, the rail 1507*c* may be connected to the frame pole 1519 by pipe straps connected to the front and back of the rail 1507*c* where the mechanical attachments 1521*c* and 1523*c* are located.

In some embodiments, the frame poles 1515, 1517 and 1519 may include the features of the rails 1507 within the frames of the windows 1509, 1511 and 1513. For example, the frame poles 1515, 1517 and 1519 may include a channel that corresponds to the slide design for the movable support rest 1505. During assembly and use, a person may insert a rail fitting, such as the slides, of the movable support rest 1505 into the channel and use the movable support rest 1505 as described herein.

Figure 16:
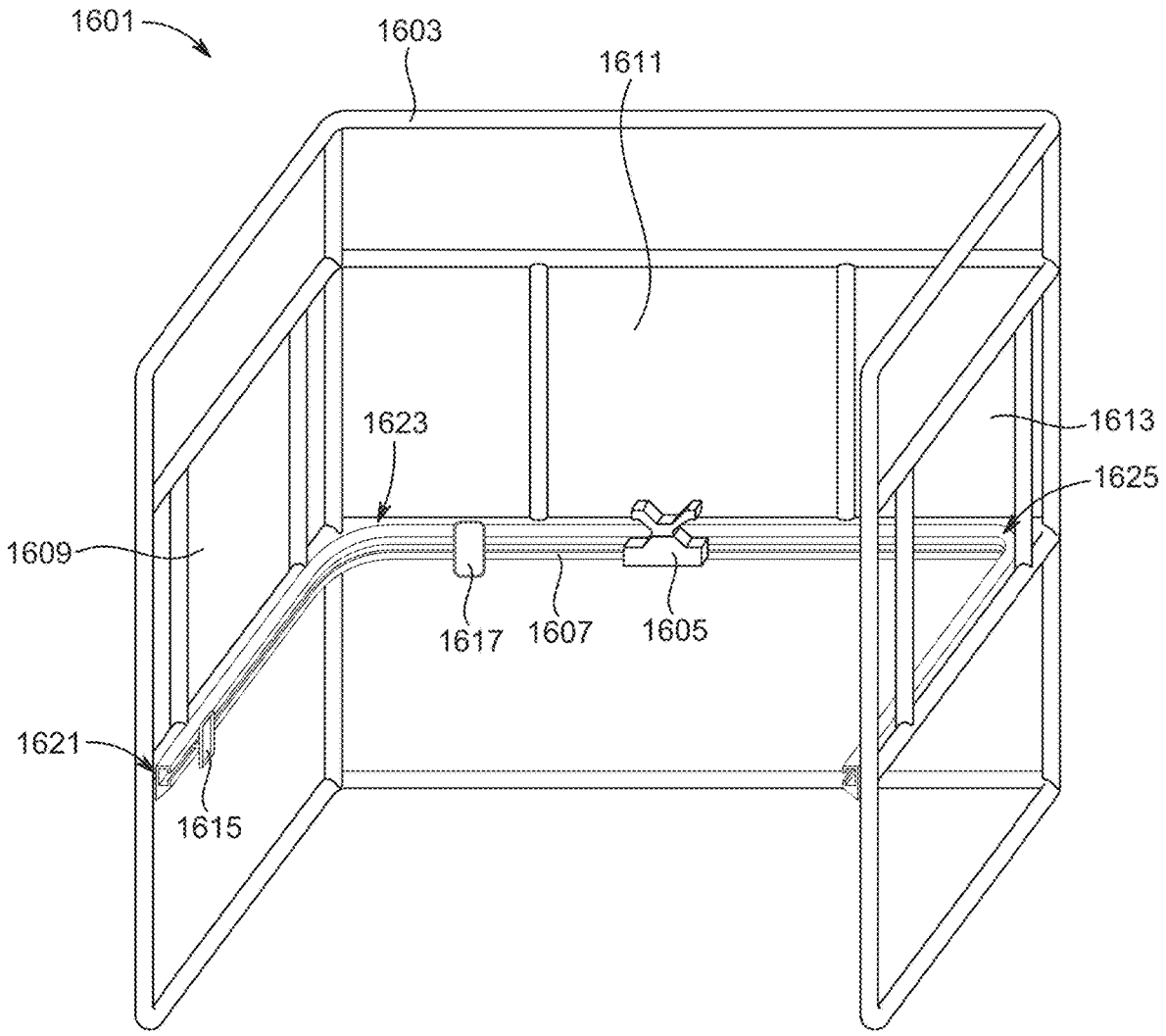
FIG. 16 is a perspective view of a structure including a support rest system in accordance with one embodiment of the present application.

FIG. 16 shows a perspective view of a support system 1601. The support system 1601 includes a structure 1603 having a support rest system. The structure may be a permanent or temporary structure such as a shelter, a blind, a tent, a platform, tree stand or another structure. In the embodiment shown, the structure 1603 is a framed structure forming the shelter design. The structure 1603 may also include a series of wall panels, coverings, canvases or other materials to enclose all or portions of the structure 1603. In some embodiments, the structure 1603 may be a permanent or semi-permanent design made from different materials, configurations or other features. For example, the structure 1603 may be a series of framed walls, such as those shown in FIG. 1. Some embodiments of the structure 1603 may include windows 1609, 1611 and 1613, which may be found in different sections or sides of the structure 1603.

In this embodiment, the support system 1601 includes a rail 1607 within the structure 1603 that supports a movable rest 1605. The rail 1607 may extend along the interior of the structure 1603 approximately at the height of the bottom of the windows 1609, 1611 and 1613. The structure 1603 shown includes three sides, each with one of the windows 1609, 1611 and 1613, with the view facing the opening within the three-sided structure 1603. The rail 1607 may have a first end at the open edge of one side of the structure 1603, followed the interior of the structure 1603 until it reaches a second end at the open edge of the other side of the structure 1603. The rail 1607 may have sweeping corners 1623 and 1625 within the structure 1603. The sweeping corners 1623 and 1625 may allow the movable rest 1605 to transition anywhere along the rail 1607. For example, the user may move the movable rest 1605 from window 1613 to window 1611 for further use by moving the movable rest 1605 in the rail 1607 through the sweeping corner 1625. In some embodiments, the rail 1607 may be a continuous rail formed from a single piece of material. For example, the rail 1607 may be a single molded or extruded component. In other embodiments, the rail 1607 may be formed from a series of segments that are joined to form a continuous rail design. For example, the rail 1607 may be formed from a series of straight segments and sweeping corners that are secured together to form a continuous rail.

In some embodiments, the rail 1607 may include a channel 1621 to accommodate slides or rollers for the movable rest 1605 to engage with the rail 1607 and move in the channel 1621. For example, the movable rest 1605 may include a roller bolt to engage the channel 1621, which will allow the movable rest to roll in the channel 1621 anywhere along the rail 1607. The design of the roller bolts may have a head or flange that forms a T-shaped profile as shown in the slide 207 in FIG. 2. The head or flange may include one or more rollers to facilitate continuous movement along the rail 1607, including around the sweeping corners. In the embodiment shown, the channel 1621 has a C-shape, which may correspond to designs discussed herein. Some embodiments of the rail 1602 may provide a static bar or member on which a movable rest 1605 with a channel will connect.

In some embodiments, accessory components may be attached to the rail 1607, such as a mobile phone holder 1617 and hanger 1615. The accessory components may include a track slider or a roller that fits into the channel 1621 to allow the accessory component to be moved along the rail 1607. In some embodiments, the accessory component may include a lock, restraint or other control feature to temporarily hold the accessory component in place. For example, the mobile phone holder 1617 may include a button to engage a mechanical attachment feature to grip a portion of the rail 1607 and limit movement of the mobile phone holder 1617.

The hanger 1615 may be configured to support another component that may be placed on the hanger 1615. For example, the structure of the hanger 1615 may correspond to a frame on the back of a container, wherein the container may be placed on the hanger 1615 by sliding the frame over the hanger 1615 or removed from the hanger 1615 by lifting the container. The container may also be moved along the rail 1607 by the slider or roller system of the hanger 1615. As another example, a user may hang an item with a strap, such as a camera, binoculars, a sight or other item, from the hanger 1615. In addition, the hanger 1615 may be designed to hold a speaker, headphones, hats, coats, eye protection or other items.

Accessory components may include other designs that include a slide or roller configured to fit the channel 1621 of the rail 1607. For example, another support system may be configured to hold a camera simultaneously with the movable rest 1605. The system may be set up to allow camera recording while using the movable rest 1605. Another example component may be a spotting scope rest to sight items in the distance. Other accessories may include cup holders, animal calls, scent devices, ammo or shell holders, disposal containers, light holders, boxes and other components. In some embodiments, the accessory holders may also include flex systems to minimize any effect from firearm discharge or other shock. This support system 1601 allows for multiple simultaneous components attached to the rail 1607 along with the movable rest 1605. In some embodiments, the support system 1601 may include multiple movable rests 1605 and accessory components simultaneously.

Figure 17:
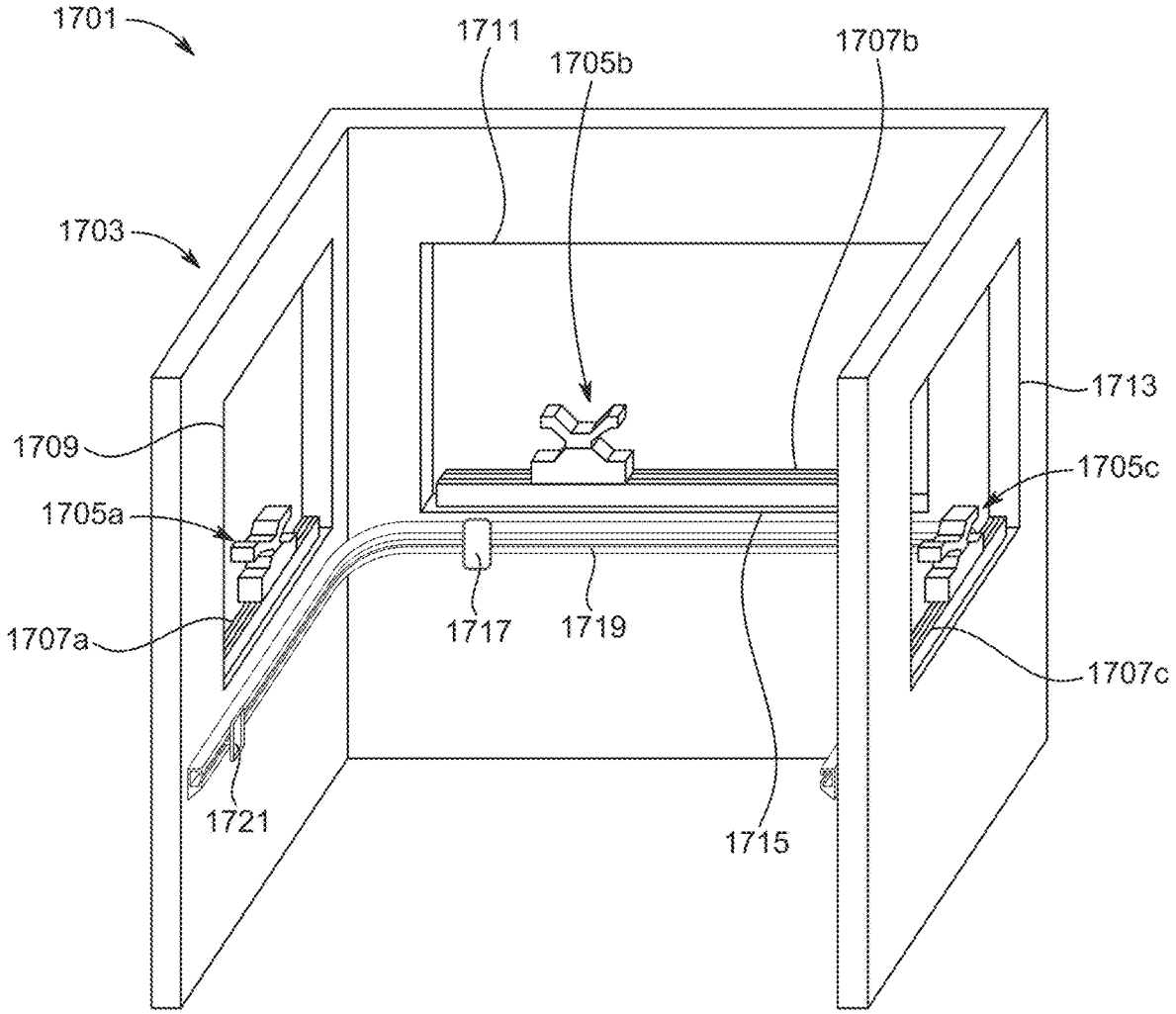
FIG. 17 is a perspective view of another structure including a support rest system in accordance with another embodiment of the present application.

FIG. 17 shows a perspective view of a support system 1701. The support system 1701 includes a structure 1703 having a support rest system. The structure may be a permanent or temporary structure such as a shelter, a blind, a tent, a platform, tree stand or another structure. In the embodiment shown, the structure 1703 is a series of framed walls, such as those shown in FIG. 1. Some embodiments of the structure 1703 may include windows 1709, 1711 and 1713, which may be found in different sections or sides of the structure 1703.

In this embodiment, the support system 1701 includes support rest systems positioned within each of the windows 1709, 1711 and 1713 of the structure 1703. Each of the support rest systems includes a movable support rest 1705*a*,

1705*b* and 1705*c* attached to a rail 1707*a*, 1707*b* and 1707*c* that extends within the corresponding frame of the window 1709, 1711 or 1713. Each rail 1707 is attached to the bottom 1715 of each window 1709, 1711 or 1713. Each movable support rest 1705 may be configured to move along the length of the corresponding rail 1707. These movable support rests 1705 may be configured to hold and support a firearm or other item. In some embodiments, the movable support rests 1705 may include rollers, slides or other features to facilitate movement, including features discussed with other embodiments herein.

Embodiments of the support system 1701 may include different combinations of movable support rests 1705 and rails 1707. For example, the movable support rest 1705*a* and rail 1707*a* may be configured for a slide system while the movable support rest 1705*b* and rail 1707*b* may be configured for a roller system.

In this embodiment, the support system 1701 also includes a continuous rail 1719 within the structure 1703. The continuous rail 1719 may extend along the interior of the structure 1703 approximately at the height of the bottom of the windows 1709, 1711 and 1713. The structure 1703 shown includes three sides, each with one of the windows 1709, 1711 and 1713, with the view facing the opening within the three-sided structure 1703. The continuous rail 1719 may have a first end at the open edge of one side of the structure 1703 and follow the interior of the structure 1703 until it reaches a second end at the open edge of the other side of the structure 1703. The continuous rail 1719 may have sweeping corners within the structure 1703 to transition through the structure 1703. The continuous rail 1719 may be formed from a single piece of material or a series of segments that are joined to form a continuous rail design. In some embodiments, segments and transition corners may be selected to fit alternative structures and features. For example, a blind with a hexagon shape may require more segments and alternative sweeping corners to fit the wider angles.

In some embodiments, accessory components may be attached to the continuous rail 1719, such as a mobile phone holder 1717 and hanger 1721. Similar to other embodiments herein, the accessory components may include a track slider or a roller that fits into a channel in the continuous rail 1719 to allow the accessory component to be moved along the continuous rail 1719. In some embodiments, the accessory component may include a lock, restraint or other control feature to temporarily hold the accessory component in place. In some embodiments, the hanger 1721 may be configured to support another component. For example, the hanger 1721 may correspond to a frame on the back of an ammunition container. The ammunition container may be moved along the continuous rail 1719 by the slider or roller system of the hanger 1721.

In some embodiments, an additional movable support rest may be used in the continuous rail 1719. In such embodiments, the accessory components or additional movable rest may be aligned in the same window 1709, 1711 or 1713 with one of the movable support rests 1705. The accessory components may independently move within the continuous rail 1719.

In addition to or instead of the mobile phone holder 1717 and the hanger 1721, accessory components may include other designs that include a slide or roller configured to fit a channel of the continuous rail 1719. For example, containers or supports with slides or rollers may be designed to hold accessories such as beverages, spotting scopes, animal calls, scent devices, repellants, ammunition, shells, trash, tools, knives, firearms in a resting or aligned position, light holders, boxes and other components.

In some embodiments, the support system 1701 may include a secondary movable support rest on the continuous rail 1719. The secondary movable support rest may be used in tandem with one movable support rest 1705 to provide a second point of support to the same item. For example, a user may rest a firearm in the movable support rest 1705 and the secondary movable support rest simultaneously. The user may shift both movable support rests as appropriate to adjust the angle of the firearm. In some embodiments, the secondary movable support rest may extend at an angle to provide a wider spread of support between the movable support rest 1705 and the secondary movable support rest.

In some embodiments, the accessory holders may also include flex systems to minimize any effect from firearm discharge or other shock. This support system 1701 allows for multiple simultaneous components attached to the continuous rail 1719. In some embodiments, the support system 1701 may include additional movable rests and accessory components simultaneously that may be independently positioned around the continuous rail 1719.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

The invention claimed is:

1. A movable support system for a firearm on a structure comprising:

a. a rail having an elongated design attached to the structure, wherein the rail is attached proximate to an opening in the structure and the elongated design extends along a width of the opening;

b. a movable rest comprising i. a first body that provides a firearm rest having an opening defined in part by a first arm and a second arm, wherein a portion of the firearm fits within the opening, ii. a second body attached to the first body by a flexible connection, which holds a bottom section of the first body to a top section of the second body in an abutting relationship, wherein the first body may rotate relative to the second body and the flexible connection allows the first body to temporarily disengage from the abutting relationship with the second body, and iii. a rail fitting attached to the second body, wherein the rail fitting complements the rail and is configured to connect the second body to the rail with a movable connection that allows the movable rest to travel the rail along the elongated design and position the first body within the opening; and c. a restraint system having a pad between the rail and the rail fitting, wherein the pad limits movement along the elongated design when lateral force is not applied to the movable rest, and wherein the pad allows movement when lateral force is applied to the movable rest.

2. The movable support system of claim 1, wherein the rail is spaced from the structure and has a cross-section shape and the rail fitting has a C-shaped design, wherein the C-shaped design fits around and corresponds to the cross-section shape of the rail and an open side of the C-shaped design allows sliding past a connection between the structure and the rail.

3. The movable support system of claim 1, wherein the rail has a cross-section shape including a top channel and a bottom channel and the rail fitting has a C-shaped design, wherein the C-shaped design fits around and corresponds to the cross-section shape of the rail and the rail fitting has a top prong and a bottom prong that fit into the top channel and the bottom channel of the rail.

4. The movable support system of claim 1, wherein the rail has a cross-section shape and the rail fitting has a set of rollers designed to fit around and correspond to the cross-section shape of the rail.

5. The movable support system of claim 1, wherein the structure has a plurality of openings including the opening and a plurality of movable rests including the movable rest.

6. The movable support system of claim 1, wherein the structure includes a tubular section along the opening in the structure and a mechanical attachment is designed to grip the tubular section.

7. The movable support system of claim 1, wherein the structure has a second opening and the rail extends around an inside of the structure and along from an end of the second opening, along the second opening and to a distal end of the opening, wherein the movable rest may move from proximate to the opening to proximate to the second opening continuously along the rail.

8. The movable support system of claim 7, wherein the structure has a corner between the opening and the second opening and the rail extends around the corner with a sweeping turn.

9. The movable support system of claim 1 further comprising an accessory having a rail fitting, wherein the accessory is simultaneously attached to the rail with the movable rest and is independently movable along the rail from the movable rest.

10. The movable support system of claim 9 further comprising an additional movable component, wherein the additional movable component is at least one of a second accessory and a second movable rest.

11. The movable support system of claim 9, wherein the accessory is at least one of a phone mount, a hanger, a hook, a beverage holder, a binocular holder, a spotting scope holder, a camera holder, a weapon storage holder, a knife holder, a scent holder, an insect repellant holder, an ammunition holder, a heater holder, and a container.

12. The movable support system of claim 1, wherein the flexible connection comprises an elastomeric feature attached to a base of the first body.

13. The movable support system of claim 1, wherein first body includes a hemisphere on the base that fits into a hole within the second body, and wherein an elastomeric feature attached to the hemisphere.

14. The movable support system of claim 1, wherein the flexible connection comprises a spring connected to a protrusion in a base of the first body, wherein the protrusion allows rotation of the first body within a hole of the second body and allows the first body to temporarily come out of the hole of the second body.

15. The movable support system of claim 1, wherein the structure has a second opening and further comprising a second rail that extends around an inside of the structure and along from an end of the second opening, along the second opening and to a distal end of the opening, wherein a movable component having rail fittings may move from proximate to the opening to proximate to the second opening continuously along the second rail, wherein the movable component is at least one of an accessory having a rail fitting and a second movable rest.

16. A movable support system for a structure, wherein the movable support system provides a rest for an item comprising:

a. a rail attached to the structure proximate to a window opening in the structure, wherein the rail is aligned with a bottom of the window opening;

b. a first body having a rest frame to support the item, wherein the first body has a bottom with a protrusion extending from the bottom, and having an opening defined in part by a first arm and a second arm, wherein at least a portion of the item fits within the opening, c. a second body attached to the first body by a flexible connection, wherein the second body includes a top and an opening extending into the second body from the top, wherein the protrusion of the first body fits in the opening and the flexible connection attaches to the protrusion of the first body and flexibly engages the first body to the second body in an abutting relationship, wherein the first body may rotate relative to the second body and the flexible connection allows the first body to temporarily disengage from the second body, and d. a rail fitting attached to the second body, wherein the rail fitting complements the rail and is configured to connect the second body to the rail with a movable connection; and e. a restraint system with a user control on the second body to engage the rail fitting to the rail and limit lateral movement of the second body relative to the rail.

17. The movable support system of claim 16, wherein the flexible connection is an elastomeric feature that connects to a third body that abuts the bottom of the second body and wherein the elastomeric feature extends through the opening in the second body to hold the first body flexibly to the second body with tension.

18. The movable support system of claim 17, wherein the elastomeric feature is a spring.

19. The movable support system of claim 16, wherein the rail has a cross-section shape and the rail fitting has a C-shaped design, wherein the C-shaped design fits around and corresponds to the cross-section shape of the rail and an open side of the C-shaped design faces the rail.

20. The movable support system of claim 16, wherein the rail has a cross-section shape and the rail fitting has a set of rollers designed to fit around and correspond to the cross-section shape of the rail.

21. The movable support system of claim 16, wherein the rail has a C-shaped design and the rail fitting has a T-shaped profile and is at least one of a slide and a roller.

22. The movable support system of claim 16, wherein the rail has a cross-section shape and the rail fitting has a set of slides designed to fit around and correspond to the cross-section shape of the rail.

* * * * *